US006994531B2

(12) United States Patent
Dairokuno et al.

(10) Patent No.: US 6,994,531 B2
(45) Date of Patent: Feb. 7, 2006

(54) HIGH-SPEED FLUIDIC DEVICE

(75) Inventors: Satoshi Dairokuno, Kanagawa (JP); Taikou Nawamoto, Kanagawa (JP); Hiroyuki Itoh, Kanagawa (JP); Hideo Okano, Kanagawa (JP); Takashi Baba, Kanagawa (JP)

(73) Assignee: NSK Ltd., Tokyo (JP)

( * ) Notice: Subject to any disclaimer, the term of this patent is extended or adjusted under 35 U.S.C. 154(b) by 315 days.

(21) Appl. No.: 10/420,914

(22) Filed: Apr. 23, 2003

(65) Prior Publication Data

US 2005/0074341 A1 Apr. 7, 2005

(30) Foreign Application Priority Data

| | | |
|---|---|---|
| Apr. 23, 2002 | (JP) | P. 2002-121165 |
| Sep. 26, 2002 | (JP) | P. 2002-281631 |
| Oct. 10, 2002 | (JP) | P. 2002-297543 |
| Nov. 7, 2002 | (JP) | P. 2002-324280 |

(51) Int. Cl.

| | |
|---|---|
| ***F04B 17/03*** | (2006.01) |
| ***F02B 33/40*** | (2006.01) |
| ***F16H 13/04*** | (2006.01) |
| ***F16H 13/10*** | (2006.01) |

(52) U.S. Cl. ..... 417/423.6; 123/559.1; 123/565; 476/66; 476/70

(58) Field of Classification Search ..... 417/423.6; 123/559.1, 561, 565; 476/65, 66, 61, 70
See application file for complete search history.

(56) References Cited

U.S. PATENT DOCUMENTS

| | | | | |
|---|---|---|---|---|
| 2,344,078 | A * | 3/1944 | Brissonnet et al. | 123/559.1 |
| 2,577,180 | A * | 12/1951 | Buchi | 476/66 |
| 2,835,238 | A * | 5/1958 | Oehrli | 123/559.1 |
| 3,380,312 | A * | 4/1968 | Barske | 476/70 |
| 3,945,270 | A * | 3/1976 | Nelson et al. | 476/65 |
| 4,709,589 | A | 12/1987 | Kraus | |
| 6,039,668 | A | 3/2000 | Kolstrup | |
| 6,397,808 | B1 | 6/2002 | Tanaka | |
| 6,554,730 | B1 * | 4/2003 | Sakai et al. | 476/61 |
| 6,796,126 | B2 * | 9/2004 | Hasegawa et al. | 123/559.1 |

FOREIGN PATENT DOCUMENTS

| | | | |
|---|---|---|---|
| JP | 4-203421 | A | 7/1992 |
| JP | 7-122453 | B | 12/1995 |
| JP | 10-316081 | A | 12/1998 |
| JP | 11-502596 | A | 3/1999 |
| JP | 11-294548 | A | 10/1999 |
| JP | 2001-59469 | A | 3/2001 |
| JP | 2001-271897 | A | 10/2001 |
| JP | 2002-221263 | A | 8/2002 |

* cited by examiner

*Primary Examiner*—Michael Koczo, Jr.
(74) *Attorney, Agent, or Firm*—Sughrue Mion, PLLC

(57) ABSTRACT

A high-speed fluidic device has a friction roller type speed-increasing mechanism, an electric motor, and a high-speed fluidic machine, wherein: the friction roller type speed-increasing mechanism includes a housing, a low-speed side member having an outer ring provided at one end portion thereof, a high-speed side shaft rotatably supported by the housing so as to be eccentric to the low-speed side member and the outer ring, at least one guide roller rotatably supported between the outer ring and the high-speed side shaft, and at least one movable roller rotatably supported between the outer ring and the high-speed side shaft; the electric motor drives the friction roller type speed-increasing mechanism; and the high-speed fluidic machine is connected to the high-speed side shaft so as to be driven by the high-speed side shaft.

4 Claims, 17 Drawing Sheets

ONE-WAY POWER TRANSMISSION TYPE

TWO-WAY POWER TRANSMISSION TYPE

HIGH-SPEED FLUIDIC DEVICE

BACKGROUND OF THE INVENTION

1. Field of the Invention

The present invention relates to a high-speed fluidic device for pouring a fluid by high-speed rotation and particularly to a high-speed fluidic device including a high-speed fluidic machine such as a turbo machine, a supercharger or a ventilator.

2. Description of the Related Art

As a high-speed fluidic device, a supercharger for vehicle engine has been heretofore disclosed, for example, in JP-A-4-203421 and JP-A-11-294548. The supercharger is of a centrifugal type in which motive power is directly belt-transmitted from a drive shaft of an engine to a speed-increasing mechanism to increase speed to thereby drive an impeller of the speed-increasing mechanism to rotate.

In the device disclosed in JP-A-4-203421, a planetary gear mechanism is used to make the speed-increasing rate of the speed-increasing mechanism high. When the number of revolutions exceeds a value in a range of from the order of tens of thousands of rpm to the order of a hundred thousand of rpm, there is however a large problem in life as well as in vibration and noise of gears.

On the other hand, the device disclosed in JP-A-11-294548 is of a type using a planetary roller of a friction roller mechanism. The device has a structure in which pressuring force required for traction drive is obtained when the planetary roller and a sun shaft are tightened by a flexible outer ring. For this reason, slip occurs in a state of high rotational speed and high torque so that drive power cannot be transmitted to the impeller. In order to prevent this slip, the outer ring needs to tighten the planetary roller by a more intensive force. If so, efficiency is lowered because the planetary roller is pressed by an excessive pressing force in a state of low rotational speed and low torque. At the same time, there is a problem in life because an intensive pressing force always works.

As described above, in the method in which motive power is obtained by direct belt transmission from the drive shaft of the engine, the mount position of the supercharger is inevitably limited to a position on the same plane with a pulley mounted on a crankshaft of the engine.

On the other hand, an engine room is much crowded with the recent advance of functionalization of the engine, electronic application to an automobile, security safeguards against collision of a vehicle body, and so on. There is no degree of freedom for the installation position of the supercharger.

From the supercharger side, the distance to an air-intake port of the engine, the installation position of an inter-cooler, the distance to the inter-cooler, and so on, are required to be optimized.

It is however difficult to optimize these distances and installation position because the installation position of the supercharger is limited for the aforementioned reason.

In the method in which motive power is taken out from the crankshaft of the engine, the number of revolutions of a turbine in the supercharger is proportional to the number of revolutions of the engine. As a result, if the supercharger is designed so that a sufficient supercharging effect can be obtained even in the case where the engine rotates at a low speed, there is a disadvantage in that the quantity of supply air and boost pressure become too large inevitably when the engine rotates at a high speed. As a method for eliminating this disadvantage, the provision of a continuously variable transmission apparatus or an electromagnetic clutch in an input pulley portion of the speed-increasing mechanism has been proposed. In this method, there is however a problem that the system is complicated to bring increase in weight, volume and cost.

Under such circumstances, an object of the invention is to provide a high-speed fluidic device in which high transmission efficiency can be obtained as well as quiet and smooth motive power transmission can be performed and which is high both in installability and in controllability, small in size, light in weight and low in cost.

The transmission motive power of the friction roller type transmission exhibits 20 kW at maximum and about 5 kW in an ordinary state even in a light-pressure type having a supercharging pressure of about 1.5 atmospheres for 2 L engine. When an electric motor is used as a drive source on the assumption that the efficiency of the electric motor is about 90%, heat of about 2 kW is generated when the maximum transmission motive power is produced and heat of about 0.5 kW is generated when the transmission motive power is 5 kW.

As described above, the efficiency of the friction roller type transmission is high on the whole region but a loss of about 5% occurs even in the case where the efficiency is 95%. A large part of the loss makes a heat loss. This heat loss is added to a heat loss of the electric motor. Furthermore, a larger amount of heat is generated in a supercharger for large exhaust capacity engine or a supercharger high in supercharging pressure. In addition, heat is further generated by adiabatic compression when air is compressively fed to the engine by the impeller.

SUMMARY OF THE INVENTION

Under such circumstances, an object of the invention is to provide a high-speed fluidic device in which high transmission efficiency can be obtained as well as quiet and smooth motive power transmission can be performed and which is high both in installability and in controllability, small in size, light in weight and low in cost. In addition to this, an object of the invention is to provide a drive device and a high-speed fluidic device in which high transmission efficiency can be obtained as well as quiet and smooth motive power transmission can be performed and in which the temperature of a friction roller type transmission can be prevented from increasing excessively as well as the axial length can be shortened remarkably to attain reduction in size.

In attaining the above object, according to a first aspect of the present invention, there is provided a high-speed fluidic device having a friction roller type speed-increasing mechanism, an electric motor, and a high-speed fluidic machine, wherein: the friction roller type speed-increasing mechanism includes a housing, a low-speed side member having an outer ring provided at one end portion thereof, a high-speed side shaft rotatably supported by the housing so as to be eccentric to the low-speed side member and the outer ring, at least one guide roller rotatably supported between the outer ring and the high-speed side shaft, and at least one movable roller rotatably supported between the outer ring and the high-speed side shaft; the electric motor drives the friction roller type speed-increasing mechanism; and the high-speed fluidic machine is connected to the high-speed side shaft so as to be driven by the high-speed side shaft.

In the above construction, the high-speed fluidic machine may be a supercharger.

In the above construction, the supercharger may be a centrifugal high-speed fluidic machine.

In the above construction, the low-speed side member may be a low-speed side shaft rotatably supported by the housing.

In the above construction, the high-speed fluidic device further has a continuously stationary member fixed to the housing, wherein the low-speed side member may be a low-speed side ring rotatably supported by the continuously stationary member. In attaining the above object, according to a second aspect of the present invention, there is provided a high-speed fluidic device having a friction roller type speed-increasing mechanism, an electric motor, and a high-speed fluidic machine, wherein: the friction roller type speed-increasing mechanism includes a housing, a low-speed side shaft rotatably supported by the housing and having an outer ring provided at one end portion thereof, a high-speed side shaft rotatably supported by the housing so as to be eccentric to the low-speed side shaft and the outer ring, at least one guide roller rotatably supported between the outer ring and the high-speed side shaft, and at least one movable roller rotatably supported between the outer ring and the high-speed side shaft; the electric motor includes a drive shaft connected to the low-speed side shaft; and the high-speed fluidic machine is connected to the high-speed side shaft so as to be driven by the high-speed side shaft.

In attaining the above object, according to a third aspect of the present invention, there is provided a high-speed fluidic device having a friction roller type speed-increasing mechanism, an electric motor, and a high-speed fluidic machine, wherein: the friction roller type speed-increasing mechanism includes a housing, a continuously stationary member fixed to the housing, a low-speed side ring rotatably supported by the continuously stationary member, an outer ring fitted to an inner diameter side of the low-speed side ring so as to rotate together with the low-speed side ring, a high-speed side shaft eccentric to the low-speed side ring and the outer ring, at least one guide roller rotatably supported between the outer ring and the high-speed side shaft, and at least one movable roller rotatably supported between the outer ring and the high-speed side shaft; the electric motor drives the friction roller type speed-increasing mechanism and includes a cylindrical rotor fitted to an outer diameter side of the low-speed side ring for driving the low-speed side ring to rotate; and the high-speed fluidic machine is connected to the high-speed side shaft so as to be driven by the high-speed side shaft.

In the above construction, the outer ring may be further spline-fitted to an inner diameter side of the low-speed side ring.

In the above construction, a cooling jacket for circulating a cooling medium may be provided in the housing.

As described above, in accordance with the invention, the high-speed fluidic device is configured so that an impeller of the high-speed fluidic machine is driven by a friction roller type speed-increasing mechanism using a wedging function written in later. Because the wedge roller type speed-increasing mechanism is such a traction drive that quiet and smooth motive power transmission can be performed even at a high rotational speed, there is no problem in vibration and noise. Furthermore, because this is such a mechanism that pressing force required for the traction drive can be obtained by the wedging function, a proper pressing force proportional to transmission torque can be always obtained so that no slip occurs. At the same time, high efficiency can be obtained in a wide region of from a region of low rotational speed and low torque to a region of high rotational speed and high torque. In addition, because the electric motor is incorporated in the high-speed fluidic device, the position of installation in an engine room is not limited so that the electric motor can be installed in an optimal position.

When the invention is applied to a centrifugal supercharger in the condition that the high-speed fluidic machine in the high-speed fluidic device according to the invention is a centrifugal fluidic machine, the centrifugal supercharger per se is small-sized as well as the motor can be small-sized because of high efficiency. Accordingly, there is a merit that electric power for driving the motor can be reduced as well as good installability can be obtained.

When, for example, the high-speed fluidic device according to the invention is used in an engine supercharger, the motor can be controlled to obtain an optimal number of revolutions continuously. Accordingly, the quantity of supply air and boost pressure of the supercharger can be prevented from becoming excessive when the engine rotates at a high speed. Optimal supercharging can be always performed without provision of any other unit such as a continuously variable transmission.

Furthermore, in accordance with the invention, the electric motor has a cylindrical rotor which is fitted to the outer diameter side of the low-speed side ring to thereby drive the low-speed side ring to rotate. Accordingly, the axial length can be shortened remarkably, so that reduction in size of the high-speed fluidic device can be attained.

Because the outer ring is spline-fitted to the inner diameter side of the low-speed side ring, the outer ring has a degree of freedom in a radial direction. Dimensional tolerance or displacement in mount position of the movable roller, the guide roller, the support shafts of the rollers, the outer ring and the high-speed side shaft can be absorbed so that the contact surface pressure of each contact portion can be set to be an optimal value. Accordingly, high transmission efficiency can be kept.

Because the cooling jacket for circulating a cooling medium is provided in the housing, the friction roller type transmission can be cooled so efficiently that the temperature of the friction roller type transmission can be prevented from increasing excessively. Accordingly, increase in cost caused by the provision of a new exclusive cooling unit (a cooler, a pump, a temperature sensor, an ON/OFF switch, etc.) can be avoided. The friction roller type transmission can be cooled efficiently, so that performance and durability can be kept stable at low cost.

Because the electric motor is incorporated in the high-speed fluidic device, the position of installation in an engine room is not limited so that the electric motor can be installed in an optimal position.

Incidentally, there has been heretofore no speed-increasing mechanism capable of increasing the number of revolutions to be larger than a value in a range of from the order of tens of thousands of rpm to the order of a hundred thousand of rpm. Such a system driven by an electric motor has been never obtained.

The high-speed fluidic device according to the invention can be applied not only to the engine supercharger but also to a ventilator for feeding hydrogen as fuel, a blower for blowing out water and water vapor produced by a reaction of hydrogen and oxygen, and so on, for example, in a vehicle powered by fuel battery.

Incidentally, a traction drive type transmission has been developed for various industrial purposes because of quiet and smoothness. A trial to apply the traction drive type transmission to a personal use for an automobile or a bicycle has been made in recent years. The traction drive type transmission has been widely noticed as a next-generation motive power transmission system.

The traction drive type transmission is a mechanism in which at least two rotating bodies having smooth surfaces are strongly pressed against each other through a lubricating oil film (e.g., EHL oil film) interposed between the rotating bodies to transmit motive power by means different from gear transmission. The fundamental equation of this mechanism can be expressed as a simple equation of friction: $Ft=\mu \cdot Fc$ (Ft: traction force). In this equation, Fc is called "pressing force". Various methods for generating the pressing force have been developed.

The friction roller type transmission using a wedging function (hereinafter referred to as "wedge roller type transmission" in this specification) is one of the traction drive type transmissions. The wedge roller type transmission means a transmission which has: an outer ring rotatably provided around a front end portion of the high-speed side shaft so as to be eccentric to the high-speed side shaft; and at least one guide roller and at least one movable roller disposed in an annular space formed between a driven side cylindrical surface as the outer circumferential surface of the high-speed side shaft and a drive side cylindrical surface as the inner circumferential surface of the outer ring so that the width of the annular space in a radial direction varies according to a circumferential direction, each of the guide roller and the movable roller having an outer circumferential surface as a motive power transmission cylindrical surface. The movable roller means a roller which generates pressing force by its wedging function and which moves both in the radial direction and in the circumferential direction.

DETAILED DESCRIPTION OF THE PREFERRED EMBODIMENTS

A high-speed fluidic device using a wedge roller type transmission according to embodiments of the invention will be described below with reference to the drawings.

The internal structure of the wedge roller type transmission common to all embodiments will be described in detail before first and second embodiments will be described.

Figure 1:
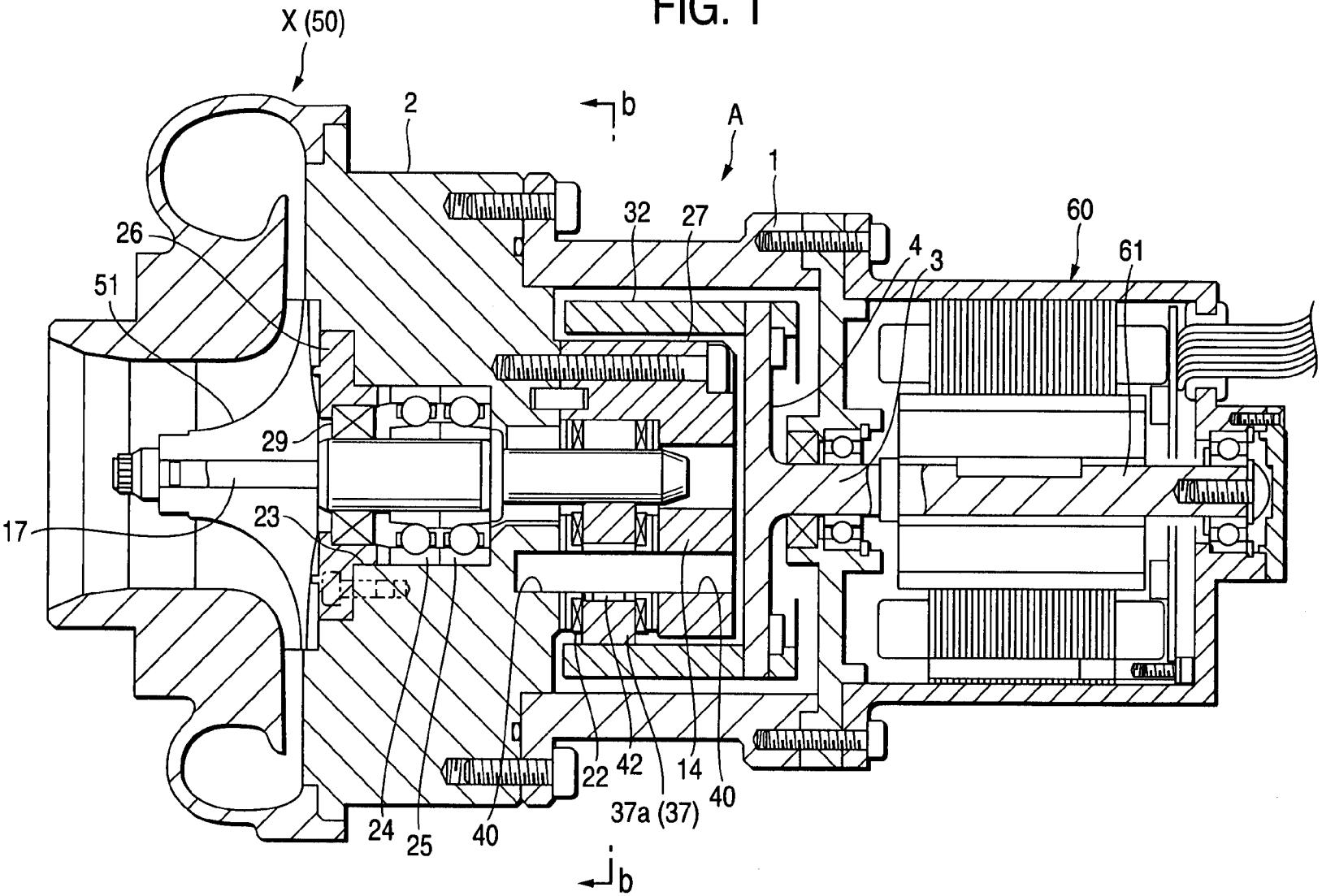
FIG. 1 is a sectional view showing the internal structure of a high-speed fluidic device using a wedge roller type transmission according to a first embodiment of the invention.
Figure 2:
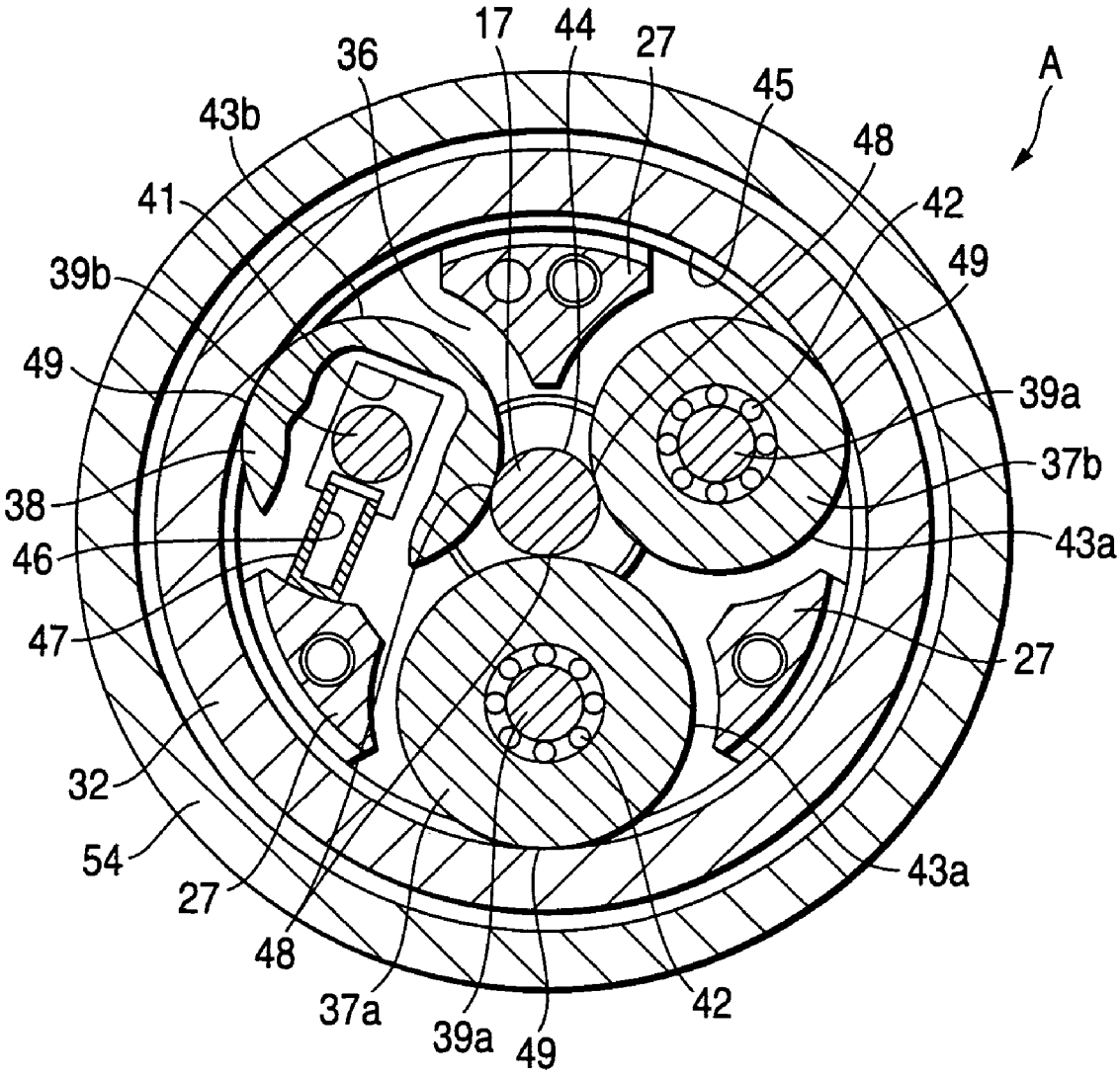
FIG. 2 is a sectional view taken along the line b—b in FIG. 1.
Figure 3:
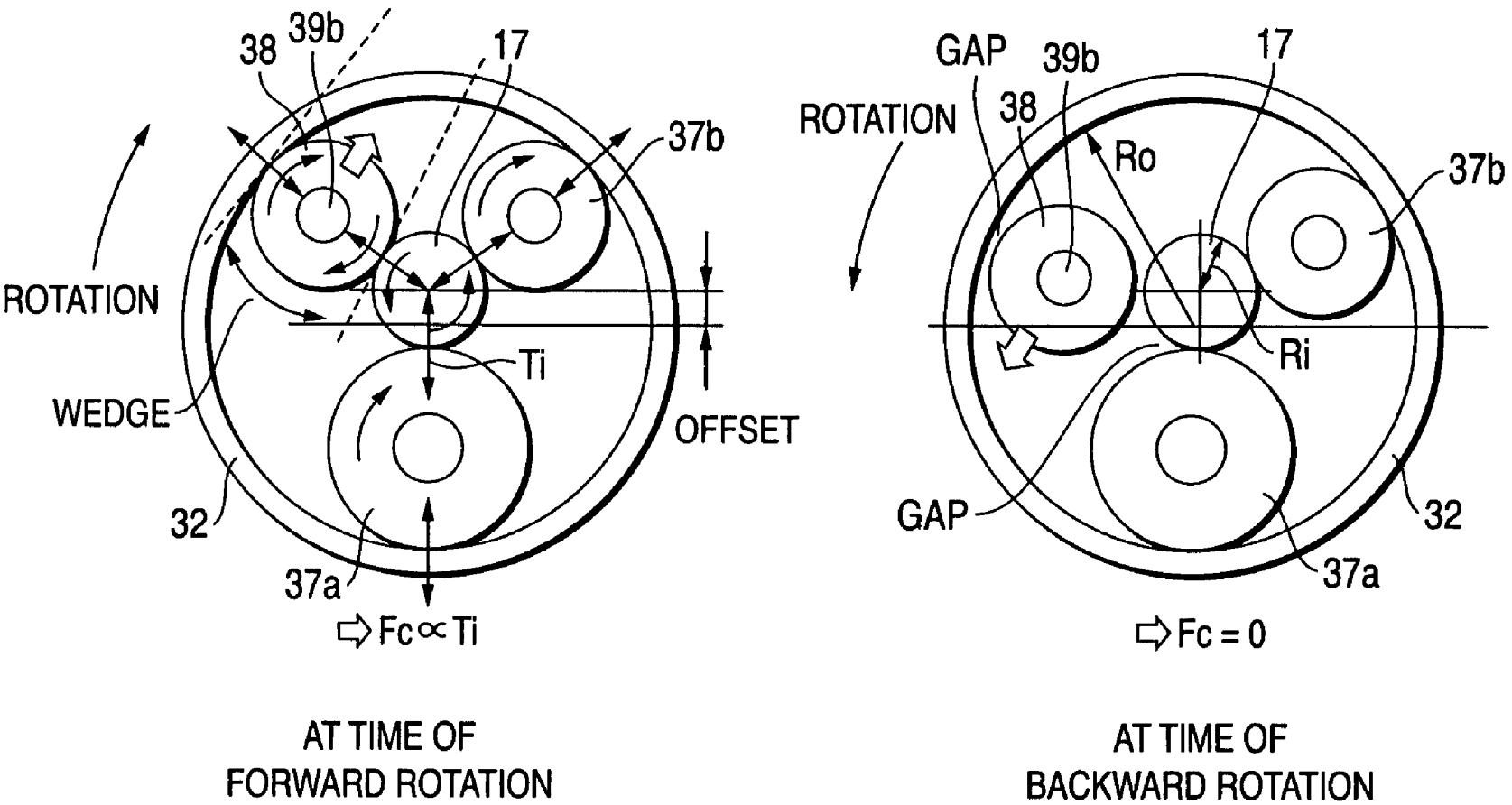
FIG. 3 is a view for explaining the function of the wedge roller type transmission.
Figure 4:
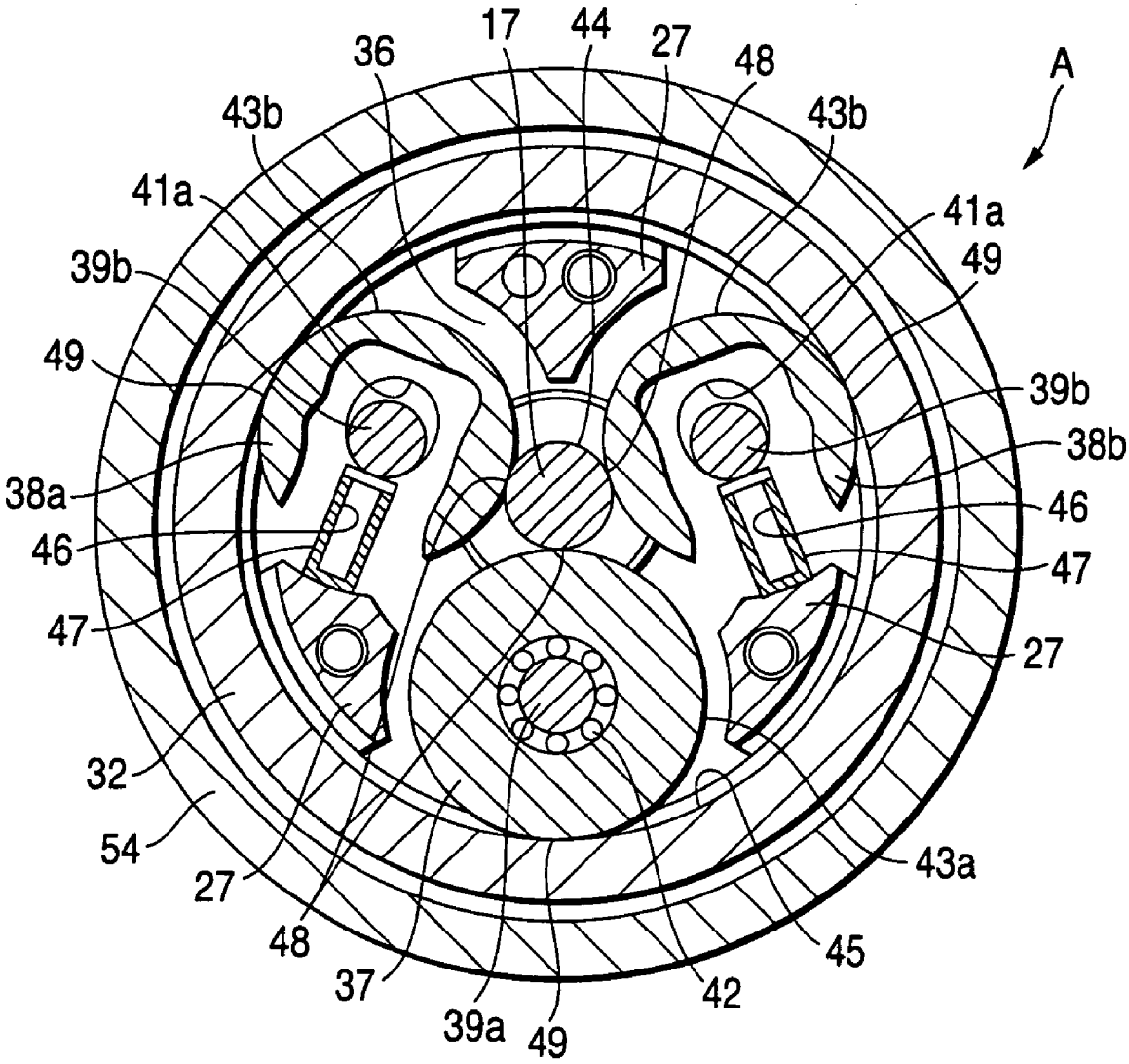
FIG. 4 is a sectional view of the wedge roller type transmission capable of transmitting torque both at the time of forward rotation and at the time of backward rotation according to the invention.

FIG. 1 is a sectional view of an engine supercharger including the wedge roller type transmission as the high-speed fluidic device according to any one of the embodiments of the invention. FIG. 2 is a sectional view, taken along the line b—b in FIG. 1, of the wedge roller type transmission having a one-way clutch function. FIG. 3 is a view for explaining the function of the wedge roller type transmission. FIG. 4 is a sectional view of the wedge roller type transmission capable of transmitting torque both at the time of forward rotation and at the time of backward rotation.

In this embodiment, the wedge roller type transmission A serves as a speed-increasing mechanism in which a low-speed side shaft 3 (outer ring side) as a low-speed side member is used as an input side while a high-speed side shaft 17 is used as an output side. Incidentally, this transmission can be also applied to a speed-reducing mechanism using the low-speed side shaft (outer ring side) as an output side.

The wedge roller type transmission A may have a one-way clutch function capable of transmitting torque at the time of forward rotation but incapable of transmitting torque because of idling at the time of backward rotation as shown in FIG. 2 or may have a function capable of transmitting torque both at the time of forward rotation and at the time of backward rotation as shown in FIG. 4.

In the wedge roller type transmission A according to any one of the embodiments of the invention, as shown in FIGS. 1 and 2, a housing 2 which is a partition plate is fixed to a nearly cylindrical housing 1. The low-speed side shaft 3 is rotatably supported by the housing 1. A disk member 4 is provided at an end portion of the low-speed side shaft 3 in the housing 1. An outer ring 32 is attached to an outer edge portion of the disk member 4.

The high-speed side shaft 17 is rotatably provided in the housing 2 as a partition plate so as to be eccentric (offset) to the low-speed side shaft 3 and the outer ring 32.

As shown in FIG. 2, a large-diameter guide roller 37*a*, a small-diameter guide roller 37*b* and a movable roller 38 are interposed between the outer ring 32 and the high-speed side shaft 17. The movable roller 38 moves at the time of torque transmission.

A support shaft 39*b* for rotatably supporting the movable roller 38 is formed so that the support shaft 39*b* can move in a "wedging" direction in between the high-speed side shaft 17 and the outer ring 32 as shown in FIG. 3. An elastic member 47 (see FIG. 2) such as a compression spring is disposed in a cylinder bore 46 so that the elastic member 47 urges the support shaft 39*b* toward the "wedging" direction.

Accordingly, as shown in FIG. 3, at the time of forward rotation, the movable roller 38 moves in the "wedging" direction in between the high-speed side shaft 17 and the outer ring 32 to thereby generate pressing force Fc. Traction force is generated on the basis of the pressing force Fc, so that torque can be transmitted.

On the other hand, at the time of backward rotation, the movable roller 38 moves in an "unwedging" direction. As a result, the pressing force Fc becomes zero, so that the outer ring 32 rotates idly to make it impossible to transmit torque to the high-speed side shaft 17.

As shown in FIG. 2, an annular space 36 is provided between the inner circumferential surface of the outer ring 32 and the outer circumferential surface of a front end portion of the high-speed side shaft 17 so that the width of the annular space 36 in a radial direction varies according to a circumferential direction.

In such an annular space 36, two guide rollers 37*a* and 37*b* and one movable roller 38 are disposed to form the wedge roller type transmission A. The movable roller 38 is partially shown in FIG. 2 as if it were partially cut away. Three support shafts 39*a*, 39*a* and 39*b* are provided in the portion of the annular space 36 so that the rollers 37*a*, 37*b* and 38 can be installed. Two support shafts 39*a* and 39*a* of the three support shafts 39*a*, 39*a* and 39*b* are provided so that opposite end portions of the support shafts 39*a* and 39*a* are forced and fixed into fitting holes 40 and 40 formed in the housing 2 and a connecting plate 14. Accordingly, the two support shafts 39*a* and 39*a* are never displaced in the circumferential direction or in the diametral direction in the annular space 36. On the other hand, the support shaft 39*b*, which is residual one of the three support shafts 39*a*, 39*a* and 39*b* and which is located in the upper left in FIG. 2, has opposite end portions which are supported to the housing 2 and the connecting plate 14 so that they can be slightly displaced in both circumferential and diametral directions of the outer ring 32. Therefore, bearing holes 41 each having an inner diameter larger than the outer diameter of the support shaft 39*b* are formed in portions which are part of the housing 2 and the connecting plate 14 and which match with the opposite end portions of the support shaft 39*b*. The opposite end portions of the support shaft 39*b* are loosely engaged with the bearing holes 41 respectively.

The guide rollers 37*a* and 37*b* and the movable roller 38 are rotatably supported around intermediate portions of the support shafts 39*a*, 39*a* and 39*b* supported in the aforementioned manner, by bearings such as radial needle roller bearings 42 and 42, and so on, respectively. The bearing for the movable roller 38 is not shown in FIG. 2. Incidentally, protrusions 27 formed on a single surface of the connecting plate 14 in order to connect and fix the connecting plate 14 to the housing 2 are disposed between the guide rollers 37*a* and 37*b* and the movable roller 38 in the circumferential direction of the connecting plate 14. In other words, the protrusions 27 and the guide rollers 37*a* and 37*b* or the movable roller 38 are disposed alternately in the annular space 36 in the circumferential direction of the annular space 36. The outer circumferential surface of each of the guide rollers 37*a* and 37*b* and the movable roller 38 does not interfere (rub) with the circumferential side surface of each of the protrusions 27.

In this manner, each of motive power transmission cylindrical surfaces 43*a*, 43*a* and 43*b*, which are the outer circumferential surfaces of the guide rollers 37*a* and 37*b* and the movable roller 38 supported between the housing 2 and the connecting plate 14 by the support shafts 39*a*, 39*a* and 39*b* respectively, is made to abut both on a driven side cylindrical surface 44 as an outer circumferential surface of a front end portion of the high-speed side shaft 17 and on a drive side cylindrical surface 45 as an inner circumferential surface of the outer ring 32. As described above, the radial width of the annular space 36 in which the guide rollers 37*a* and 37*b* and the movable roller 38 are disposed varies according to the circumferential direction. In this manner, the outer diameters of the guide rollers 37*a* and 37*b* and the movable roller 38 are made different by the variation in the width of the annular space 36 according to the circumferential direction. That is, the outer diameters of the movable roller 38 and the guide roller 37*b* located on the eccentric side (upper side in FIG. 2) of the front end portion of the high-speed side shaft 17 to the outer ring 32, among the guide rollers 37*a* and 37*b* and the movable roller 38, are made to be equal to each other and relatively small. On the other hand, the outer diameter of the guide roller 37*a* located on a side (lower side in FIG. 2) opposite to the eccentric side of the front end portion of the high-speed side shaft 17 to the outer ring 32 is made to be larger than the outer diameter of each of the movable roller 38 and the guide roller 37*b*. In this condition, each of the motive power transmission cylindrical surfaces 43*a*, 43*a* and 43*b*, which are the outer circumferential surfaces of the guide rollers 37*a* and 37*b* and the movable roller 38, is made to abut on the driven side and drive side cylindrical surfaces 44 and 45.

Incidentally, opposite end portions of the support shafts 39*a* and 39*a* which support the guide rollers 37*a* and 37*b* out of the guide rollers 37*a* and 37*b* and the movable roller 38 respectively, are fixed (in the annular space 36) to the housing 2 and the connecting plate 14 as described above. On the other hand, the support shaft 39*b* supporting the movable roller 38 is supported (in the annular space 36) to the housing 2 and the connecting plate 14 so that the support shaft 39*b* can be slightly displaced in the circumferential and diametral directions as also described above. Accordingly, the movable roller 38 can be also slightly displaced in the circumferential and diametral directions in the annular space 36. The support shaft 39*b* supporting the movable roller 38 is elastically slightly pressed by the elastic member 47 such as a compression spring disposed in the cylinder bore 46 formed in the housing 2 and the connecting plate 14 so that the movable roller 38 rotatably supported by the support shaft 39*b* is urged to move toward a narrow portion of the annular space 36.

When the wedge roller type transmission configured as described above is to drive a rotary shaft to rotate, driving force is input to the low-speed side shaft 3 to thereby rotate the outer ring 32 clockwise in FIG. 2. The rotation of the outer ring 32 is transmitted to the high-speed side shaft 17 through the guide rollers 37*a* and 37*b* and the movable roller 38 to thereby rotate the high-speed side shaft 17 counterclockwise in FIG. 2. Because the transmission of motive power between the outer ring 32 and each of the guide rollers 37*a* and 37*b* and the movable roller 38 and the transmission of motive power between each of the guide rollers 37*a* and 37*b* and the movable roller 38 and the high-speed side shaft 17 are entirely performed by frictional transmission, both noise and vibration generated at the time of transmission of motive power are low.

The movable roller 38 has a tendency to wedge into the narrow portion (upper center portion in FIG. 2) of the annular space 36 by a force proportional to the magnitude of torque transmitted from the outer ring 32 to the high-speed side shaft 17. For this reason, the surface pressures of the abutting portions between the drive side cylindrical surface 45 as the inner circumferential surface of the outer ring 32 and the motive power transmission cylindrical surfaces 43*a*, 43*a* and 43*b* as the outer circumferential surfaces of the guide rollers 37*a* and 37*b* and the movable roller 38 and the surface pressures of the abutting portions between the driven side cylindrical surface 44 as the outer circumferential surface of the high-speed side shaft 17 and the motive power transmission cylindrical surfaces 43*a*, 43*a* and 43*b* as the outer circumferential surfaces of the guide rollers 37*a* and 37*b* and the movable roller 38 increase as the torque increases. Conversely, when the torque is low, the surface pressures of the abutting portions become low. Accordingly, the surface pressures of these abutting portions can be optimized in accordance with the torque to be transmitted, so that torque transmission can be performed efficiently.

That is, when the outer ring 32 rotates clockwise in FIG. 2 so that the high-speed side shaft 17 is rotated counterclockwise in FIG. 2, the movable roller 38 receives a force in the same direction as the pressing force of the elastic member 47 from the drive side cylindrical surface 45 as the inner circumferential surface of the outer ring 32 and the driven side cylindrical surface 44 as the outer circumferential surface of the high-speed side shaft 17 so that the movable roller 38 has a tendency to move toward the narrow portion of the annular space 36, that is, toward the upper center in FIG. 2.

As a result, the motive power transmission cylindrical surface 43*b*, which is the outer circumferential surface of the movable roller 38, presses the drive side cylindrical surface 45 and the driven side cylindrical surface 44 intensively. The contact pressure of an inner-diameter side abutting portion 48, which is the abutting portion between the motive power transmission cylindrical surface 43*b* and the driven side cylindrical surface 44, and the contact pressure of an outer-diameter side abutting portion 49, which is the abutting portion between the motive power transmission cylindrical surface 43*b* and the drive side cylindrical surface 45, become high. When the contact pressures of the inner-diameter side and outer-diameter side abutting portions 48 and 49 related to the movable roller 38 become high as described above, the high-speed side shaft 17 and the outer ring 32 pressed by the motive power transmission cylindrical surface 43*b*, which is the outer circumferential surface of the movable roller 38, are slightly displaced in the diametral direction because of elastic deformation and assembling clearance. As a result, the contact pressures of the inner-diameter side and outer-diameter side abutting portions 48 and 49 related to each of the guide rollers 37*a* and 37*b* become high. The rotating force of the outer ring 32 can be freely transmitted to the high-speed side shaft 17 through the guide rollers 37*a* and 37*b* and the movable roller 38 on the basis of frictional engagement in the respective inner-diameter side and outer-diameter side abutting portions 48 and 49.

In this manner, the force urging the movable roller 38 to move toward the narrow portion of the annular space 36 varies in accordance with the magnitude of the rotation drive force transmitted from the outer ring 32 to the high-speed side shaft 17. As this force increases, the contact pressures of the inner-diameter side and outer-diameter side abutting portions 48 and 49 increase. Accordingly, the contact pressures according to the rotation drive force to be transmitted can be selected automatically on the basis of the aforementioned function, so that the transmission efficiency of the wedge roller type transmission A can be kept high.

In the case shown in FIG. 2, the wedge roller type transmission A has a one-way clutch function. When the rotational speed of the high-speed side shaft 17 becomes higher than a speed matching with the rotational speed of the outer ring 32, that is, higher than a speed obtained by multiplying the rotational speed of the outer ring 32 by the speed-increasing rate of the wedge roller type transmission A, the wedge roller type transmission A is disconnected. That is, in this case, the movable roller 38 is displaced to the wide side (lower left in FIG. 2) of the annular space 36 against the elastic force of the elastic member 47. As a result, the contact pressures of the inner-diameter side and outer-diameter side abutting portions 48 and 49 are reduced or eliminated, so that the rotation of the outer ring 32 is not transmitted to the high-speed side shaft 17.

Next, a wedge roller type transmission capable of transmitting torque both at the time of forward rotation and at the time of backward rotation will be described with reference to FIG. 4.

FIG. 4 shows a structure in which the high-speed side shaft 17 (see FIG. 1) can be driven to rotate both clockwise and counterclockwise. Accordingly, the structure of this example is used in combination with the high-speed fluidic machine X (see FIG. 1) so that the direction of rotation can be converted freely. In the structure of this example, one guide roller 37 and two movable rollers 38*a* and 38*b* are used as three rollers forming the wedge roller type transmission A. Of these rollers, a roller disposed in the widest portion of the annular space 36 is used as the guide roller 37 which is relatively large in diameter so that there is no change in the installation position. On the other hand, a pair of rollers provided opposite to each other with respect to the narrowest portion of the annular space 36 are used as the movable rollers 38*a* and 38*b* which are relatively small in diameter so that they can be slightly displaced in the circumferential and diametral directions. Support shafts 39*b* and 39*b* supporting the movable rollers 38*a* and 38*b* respectively are elastically pressed toward the narrowest portion of the annular space 36.

In the structure of this example configured as described above, when the outer ring 32 rotates clockwise in FIG. 4, the left movable roller 38*a* in FIG. 4 wedges into the narrow portion of the annular space 36. On the other hand, when the outer ring 32 rotates counterclockwise in FIG. 4, the right movable roller 38*b* in FIG. 4 wedges into the narrow portion of the annular space 36. In this example, the lengths, concerning the circumferential direction of the annular space 36, of bearing holes 41*a* and 41*a* formed in the housing 2 and the connecting plate 14 are limited in order to bear opposite end portions of the support shafts 39*b* and 39*b* supporting the movable rollers 38*a* and 38*b* respectively. Specifically, the position of an end portion which is of each of the bearing holes 41*a* and 41*a* and on the wider side of the annular space 36 (lower side in FIG. 4) is brought closer to the widest portion of the annular space 36 than the position shown in FIG. 2. Accordingly, the movable rollers 38*a* and 38*b* can be prevented from retreating excessively to the wide side of the annular space 36.

In this example configured as described above, either movable roller 38*a* (38*b*) wedges into the narrow portion of the annular space 36 to increase the contact pressures of the inner-diameter side and outer-diameter side abutting portions 48 and 49 related to the movable roller 38*a* (38*b*) regardless of whether the outer ring 32 rotates clockwise or counterclockwise. With respect to the other movable roller 38*b* (38*a*) displaced in a direction of retreat from the narrow portion of the annular space 36, the quantity of retreat of the movable roller 38*b* (38*a*) is limited. As a result, the contact pressures of the inner-diameter side and outer-diameter side abutting portions 48 and 49 related to the movable rollers 38*a* and 38*b* and the guide roller 37 increase sufficiently so that motive power can be efficiently transmitted from the outer ring 32 to the high-speed side shaft 17. As described above, this case is the same as the case shown in FIG. 2 except that motive power can be transmitted from the rotating outer ring 32 to the high-speed side shaft 17 regardless of whether the outer ring 32 rotates clockwise or counterclockwise. Illustration and description of the equivalent parts will be omitted.

Figure 5:
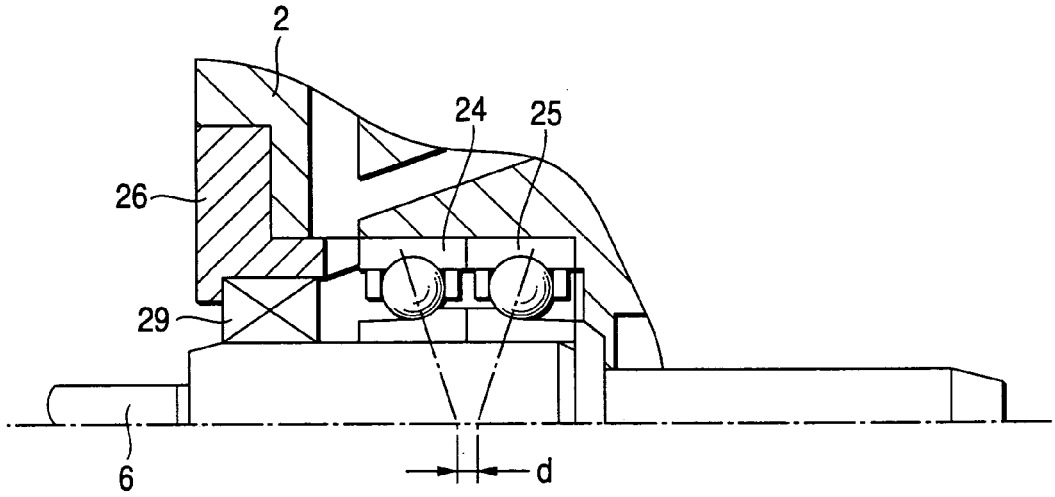
FIG. 5 is an enlarged sectional view showing an example in which two angular contact ball bearings are combined front to front with each other.

Next, a first embodiment will be described. FIG. 1 is a sectional view of an engine supercharger including a wedge roller type transmission as a high-speed fluidic device according to the first embodiment of the invention. FIG. 2 is a sectional view, taken along the line b—b in FIG. 1, of the wedge roller type transmission having a one-way clutch function. FIG. 3 is a view for explaining the function of the wedge roller type transmission. FIG. 4 is a sectional view of the wedge roller type transmission capable of transmitting torque both at the time of forward rotation and at the time of backward rotation. FIG. 5 is an enlarged sectional view showing an example in which two angular contact ball bearings are combined front to front with each other.

The pair of angular contact ball bearings 24 and 25 combined front to front with each other are interposed in a hole 23 of the partition plate (housing) 2. The bearings 24 and 25 are firmly fixed together with a sealing member 29 by a pre-load member 26. The pre-load member 26 presses outer races of the bearings 24 and 25 in the axial direction to apply pre-load.

In this manner, in this embodiment, the support of the high-speed side shaft 17 by bearings is performed only by the pair of angular contact ball bearings 24 and 25 combined front to front with each other.

On the wedge roller type transmission A side, because the two angular contact ball bearings 24 and 25 are combined front to front with each other as shown in FIG. 5, the angular rigidity of the high-speed side shaft 17 can be reduced. Accordingly, the high-speed side shaft 17 can be shaken slightly in an angular direction, so that error in machining and assembly and slight movement can be absorbed.

The high-speed side shaft 17 is supported with the rollers 37*a*, 37*b* and 38 on the wedge roller type transmission A side as well as the high-speed side shaft 17 is supported with the pair of angular contact ball bearings 24 and 25. The high-speed side shaft 17 is substantially supported at two points. For this reason, the high-speed side shaft 17 can be supported firmly on the high-speed fluidic machine X side without occurrence of any failure such as spining-rotation movement of the high-speed side shaft on the angular contact bearing as a fulcrum.

Hence, according to the invention, it is possible to satisfy the wedge roller type transmission A side requirement and the high-speed fluidic machine X side requirement which have been heretofore incompatible with each other.

Furthermore, in this embodiment, as shown in FIG. 1, a supercharger 50 which is a centrifugal high-speed fluidic machine is used as the high-speed fluidic machine X. An impeller 51 of the supercharger 50 is mounted on an end portion of the high-speed side shaft 17. Because the wedge roller type speed-increasing mechanism A is such a traction drive that quiet and smooth motive power transmission can be performed even at a high rotational speed, there is no problem in vibration and noise. Furthermore, because this is such a mechanism that pressing force required for the traction drive can be obtained by the wedging function, a proper pressing force proportional to transmission torque can be always obtained so that no slip occurs. At the same time, high efficiency can be obtained in a wide region of from a region of low rotational speed and low torque to a region of high rotational speed and high torque.

In addition, a drive shaft 61 of an electric motor 60 is integrally connected to the other end portion of the high-speed side shaft 17. Because the electric motor 60 is used as a source for driving the wedge roller type speed-increasing mechanism A as described above, the position of installation in an engine room is not limited so that the electric motor 60 can be installed in an optimal position.

Furthermore, because the electric motor 60 can be controlled to obtain an optimal number of revolutions continuously, the quantity of supply air and boost pressure of the supercharger can be prevented from becoming excessive when the engine rotates at a high speed. Optimal supercharging can be always performed without provision of any other unit such as a continuously variable transmission.

Incidentally, there has been heretofore no speed-increasing mechanism capable of increasing the number of revolutions to be larger than a value in a range of from the order of tens of thousands of rpm to the order of a hundred thousand of rpm. Such a system driven by an electric motor has been never obtained.

Further, this embodiment can be applied not only to the engine supercharger but also to a ventilator for feeding hydrogen as fuel, a blower for blowing out water and water vapor produced by a reaction of hydrogen and oxygen, and so on, for example, in a vehicle powered by fuel battery.

Although this embodiment has been described upon the case where a centrifugal high-speed fluidic machine having an impeller is used as the supercharger forming the high-speed fluidic machine, the invention may be also applied to the case where a positive-displacement high-speed fluidic machine such as a Roots machine or an axial-flow high-speed fluidic machine such as a Lysholm machine is used as the high-speed fluidic machine.

When the centrifugal supercharger 50 is used as the high-speed fluidic machine as described in this embodiment, there is a merit that excellent installability and reduction in electric power for driving the motor can be obtained because the centrifugal supercharger per se is small in size as well as the size of the electric motor 60 can be reduced because of high efficiency.

Figure 6:
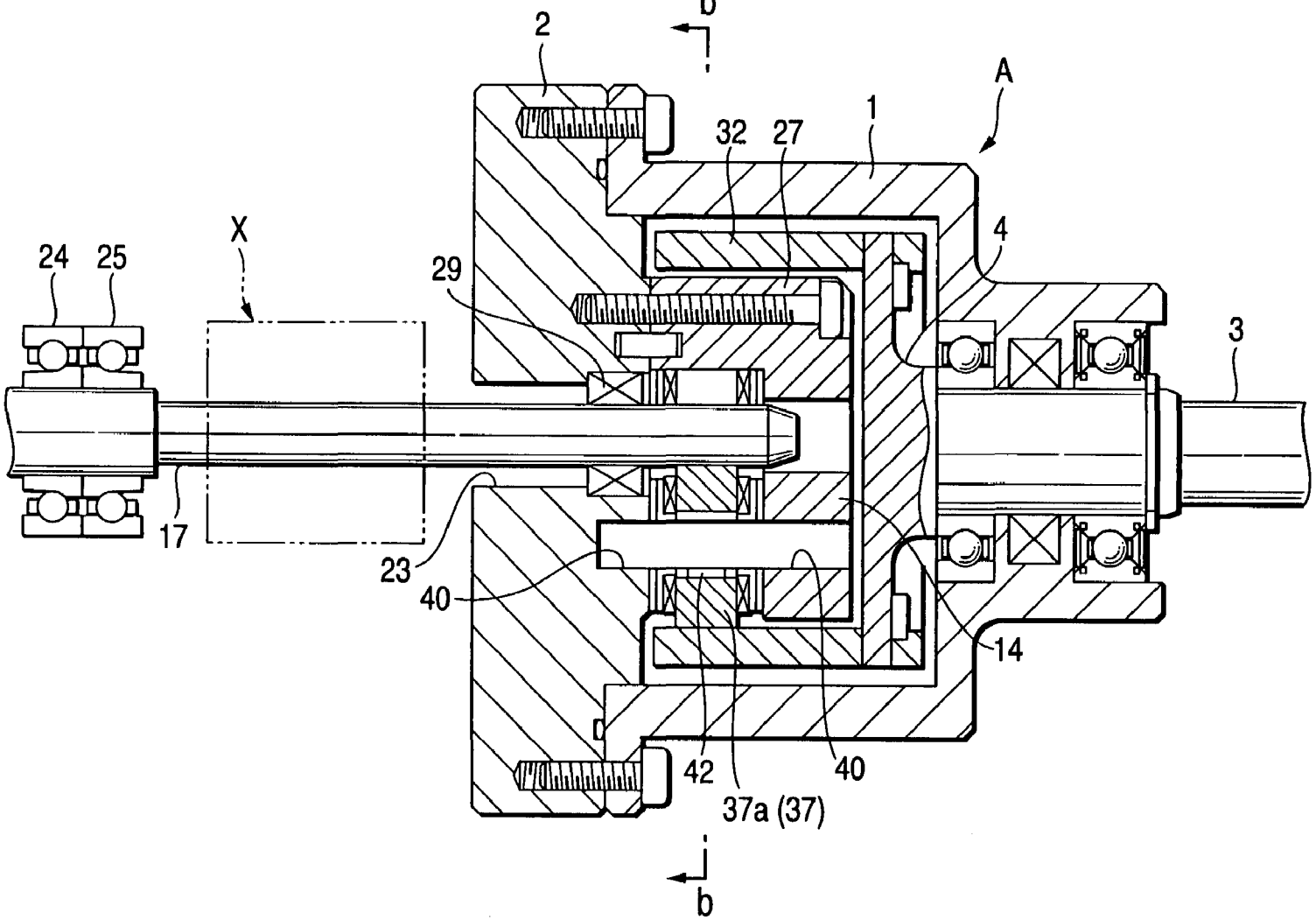
FIG. 6 is a sectional view of the wedge roller type transmission portion of the high-speed fluidic device according to a second embodiment of the invention.

FIG. 6 is a sectional view of a wedge roller type transmission according to a second embodiment of the invention. A sectional view taken along the line b—b, of the wedge roller type transmission will be omitted because it is equivalent to FIG. 2 or 4. Parts the same as those in the first embodiment are referred to by numerals the same as those in the first embodiment for the sake of omission of duplicated description.

In this embodiment, the pair of angular contact ball bearings 24 and 25 combined front to front with each other are provided not in the hole 23 of the partition plate (housing) 2 but in the other end portion of the high-speed side shaft 17.

Also in this case, because the pair of angular contact ball bearings 24 and 25 are combined front to front with each other as shown in FIG. 5, the angular rigidity of the high-speed side shaft 17 can be reduced. Accordingly, the high-speed side shaft 17 can be shaken slightly in an angular direction, so that error in machining and assembly and slight movement can be absorbed. Furthermore, the high-speed side shaft 17 is supported with the rollers 37*a*, 37*b* and 38 (see FIG. 2) on the wedge roller type transmission A side as well as the high-speed side shaft 17 is supported with the pair of angular contact ball bearings 24 and 25. The high-speed side shaft 17 is substantially supported at two points. For this reason, the high-speed side shaft 17 can be supported firmly on the high-speed fluidic machine X side without occurrence of any failure such as spining-rotation movement of the high-speed side shaft on the angular contact bearing as a fulcrum.

Further, in this embodiment, the supercharger 50 is used as the high-speed fluidic machine X. The impeller 51 of the supercharger 50 is mounted on an end portion of the high-speed side shaft 17. The drive shaft 61 of the electric motor 60 is integrally connected to the other end portion of the high-speed side shaft 17. The configuration, operation and effect of this embodiment in this case are equivalent to those of the first embodiment.

Further, this embodiment can be applied not only to the engine supercharger but also to a ventilator for feeding hydrogen as fuel, a blower for blowing out water and water vapor produced by a reaction of hydrogen and oxygen, and so on, for example, in a vehicle powered by fuel battery.

Figure 7:
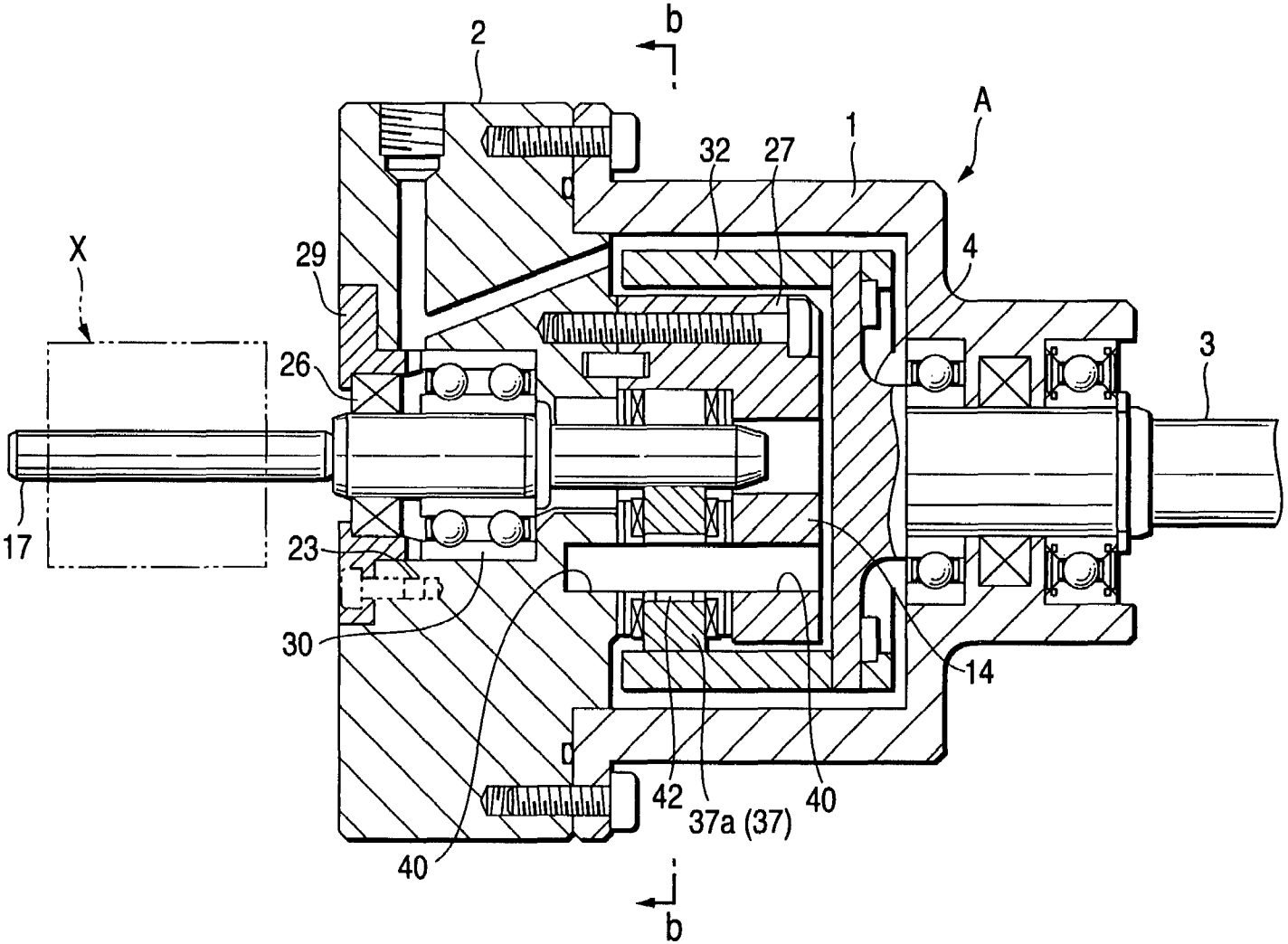
FIG. 7 is a sectional view of the wedge roller type transmission portion of the high-speed fluidic device according to a third embodiment of the invention.

FIG. 7 is a sectional view of a wedge roller type transmission according to a third embodiment of the invention. A sectional view taken along the line b—b, of the wedge roller type transmission will be omitted because it is equivalent to FIG. 2 or 4. Parts the same as those in the first embodiment are referred to by numerals the same as those in the first embodiment for the sake of omission of duplicated description.

In this embodiment, a front-to-front double row angular contact ball bearing 30 is used as a substitute for the pair of angular contact ball bearings 24 and 25 combined front to front with each other.

Also in this case, because the angular contact ball bearing 30 has two rows combined front to front with each other, the distance between points of action can be made smaller than the case where the angular contact ball bearing 30 has two rows combined back to back with each other. Accordingly, the angular rigidity of the high-speed side shaft 17 can be reduced. Accordingly, the high-speed side shaft 17 can be shaken slightly in an angular direction, so that error in machining and assembly and slight movement can be absorbed. Furthermore, the high-speed side shaft 17 is supported with the rollers 37*a*, 37*b* and 38 (see FIG. 2) on the wedge roller type transmission A side as well as the high-speed side shaft 17 is supported with the front-to-front double row angular contact ball bearing 30. The high-speed side shaft 17 is substantially supported at two points. For this reason, the high-speed side shaft 17 can be supported firmly on the high-speed fluidic machine X side without occurrence of any failure such as spining-rotation movement of the high-speed side shaft on the angular contact bearing as a fulcrum.

Further, in this embodiment, the supercharger 50 is used as the high-speed fluidic machine X. The impeller 51 of the supercharger 50 is mounted on an end portion of the high-speed side shaft 17. The drive shaft 61 of the electric motor 60 is integrally connected to the other end portion of the high-speed side shaft 17. The configuration, operation and effect of this embodiment in this case are equivalent to those of the first embodiment.

Further, this embodiment can be applied not only to the engine supercharger but also to a ventilator for feeding hydrogen as fuel, a blower for blowing out water and water vapor produced by a reaction of hydrogen and oxygen, and so on, for example, in a vehicle powered by fuel battery.

Figure 8:
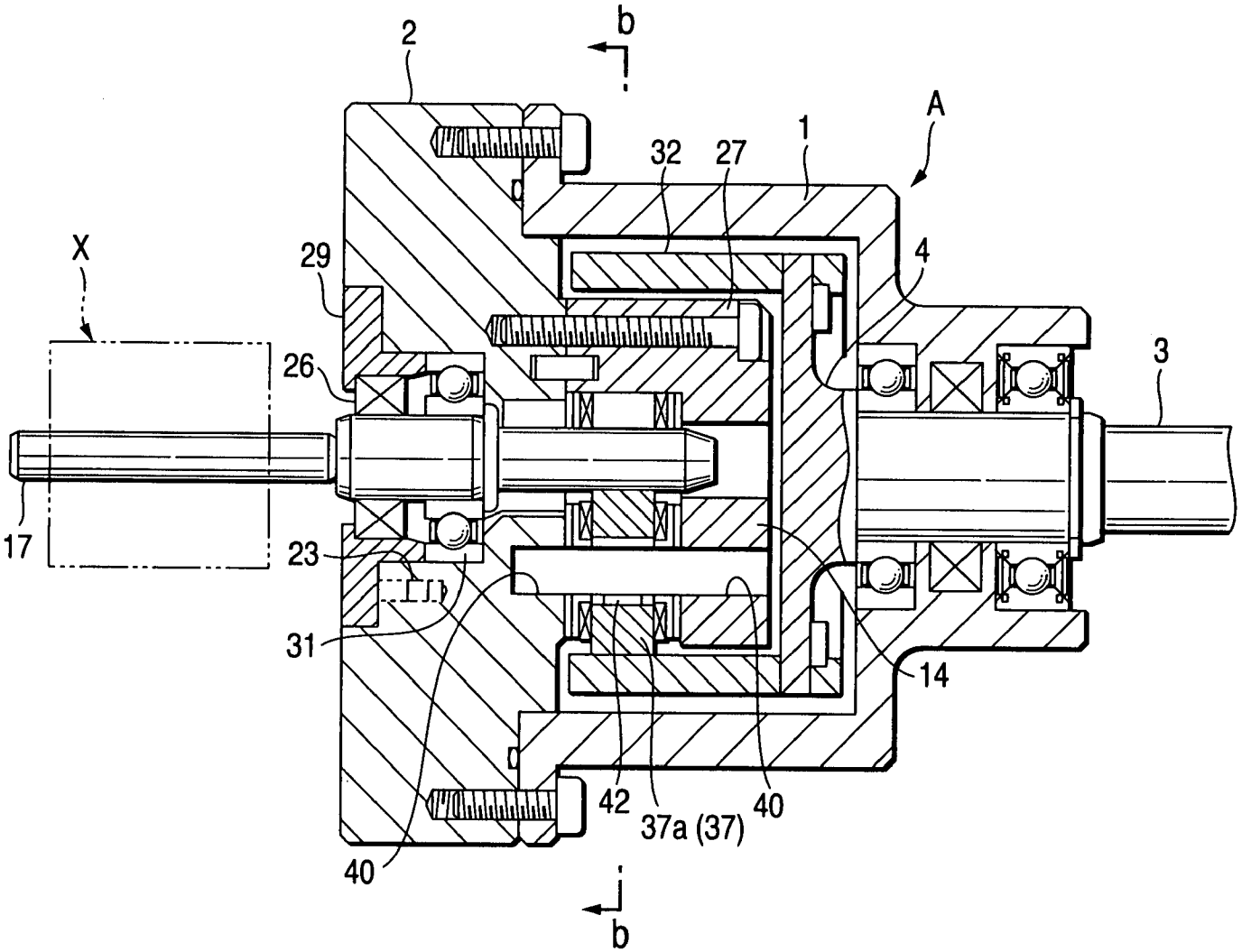
FIG. 8 is a sectional view of the wedge roller type transmission portion of the high-speed fluidic device according to a fourth embodiment of the invention.

FIG. 8 is a sectional view of a wedge roller type transmission according to a fourth embodiment of the invention. A sectional view taken along the line b—b, of the wedge roller type transmission will be omitted because it is equivalent to FIG. 2 or 4. Parts the same as those in the first embodiment are referred to by numerals the same as those in the first embodiment for the sake of omission of duplicated description.

In this embodiment, a deep groove ball bearing 31 is used as a substitute for the pair of angular contact ball bearings 24 and 25 combined front to front with each other.

In this case, because angular rigidity is not given to the high-speed side shaft 17, this embodiment can be applied to the condition that the number of revolutions is not so large.

Further, in this embodiment, the supercharger 50 is used as the high-speed fluidic machine X. The impeller 51 of the supercharger 50 is mounted on an end portion of the high-speed side shaft 17. The drive shaft 61 of the electric motor 60 is integrally connected to the other end portion of the high-speed side shaft 17. The configuration, operation and effect of this embodiment in this case are equivalent to those of the first embodiment.

Further, this embodiment can be applied not only to the engine supercharger but also to a ventilator for feeding hydrogen as fuel, a blower for blowing out water and water vapor produced by a reaction of hydrogen and oxygen, and so on, for example, in a vehicle powered by fuel battery.

Figure 9:
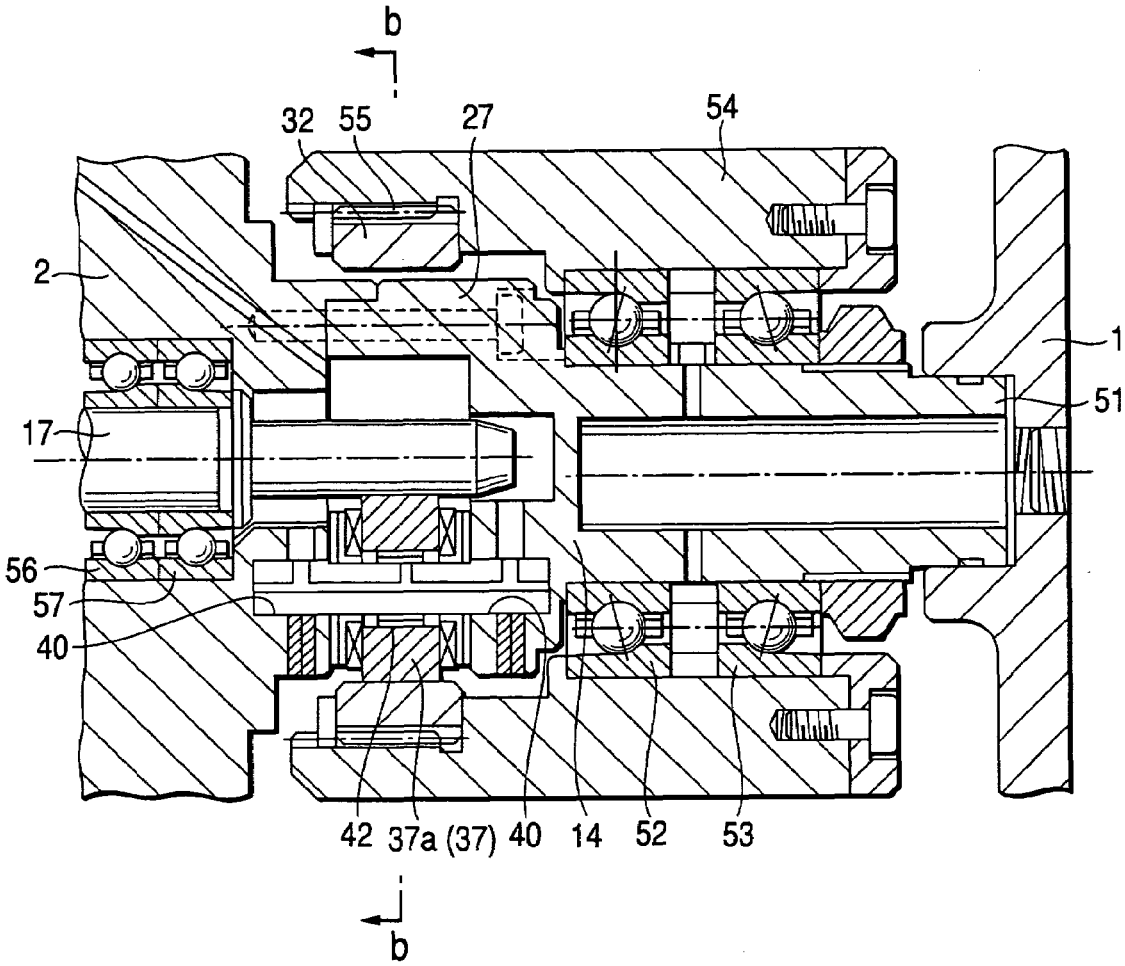
FIG. 9 is a vertical sectional view of the wedge roller type transmission according to a fifth embodiment of the invention.

FIG. 9 is a vertical sectional view of a wedge roller type transmission according to a fifth embodiment of the invention. The sectional view taken along the line b—b, of the wedge roller type transmission in FIG. 9 will be omitted because it is equivalent to FIG. 2 or 4. Parts the same as those in the first embodiment are referred to by numerals the same as those in the first embodiment for the sake of omission of duplicated description.

In this embodiment, the wedge roller type transmission A acts as a speed-increasing mechanism using a low-speed side ring 54 (outer ring side) as an input side and the high-speed side shaft 17 as an output side.

The wedge roller type transmission A according to this embodiment of the invention has a housing 1 provided in the right in FIG. 9, and a housing 2 as a partition plate provided in the left in FIG. 9.

A support shaft 51 (continuously stationary member) is fixed to a right end portion of the housing 1. A disk-like connecting portion 14 which will be described later is formed as a center portion of the support shaft 51. Three protrusions 27 are formed as a left end portion of the support shaft 51. The three protrusions 27 are connected to the housing 2 as a partition plate.

The support shaft 51 rotatably supports the low-speed side ring 54 through bearings 52 and 53.

An outer ring 32 is spline-fitted to an inner diameter side of a left end portion of the low-speed side ring 54 through a spline portion 55. The outer ring 32 can slidably move relative to the low-speed side ring 54 as well as the outer ring 32 can rotate together with the low-speed side ring 54.

The high-speed side shaft 17 is rotatably provided in the housing 2 as a partition plate through bearings 56 and 57 so as to be eccentric (offset) to the low-speed side ring 54 and the outer ring 32.

Figure 10:
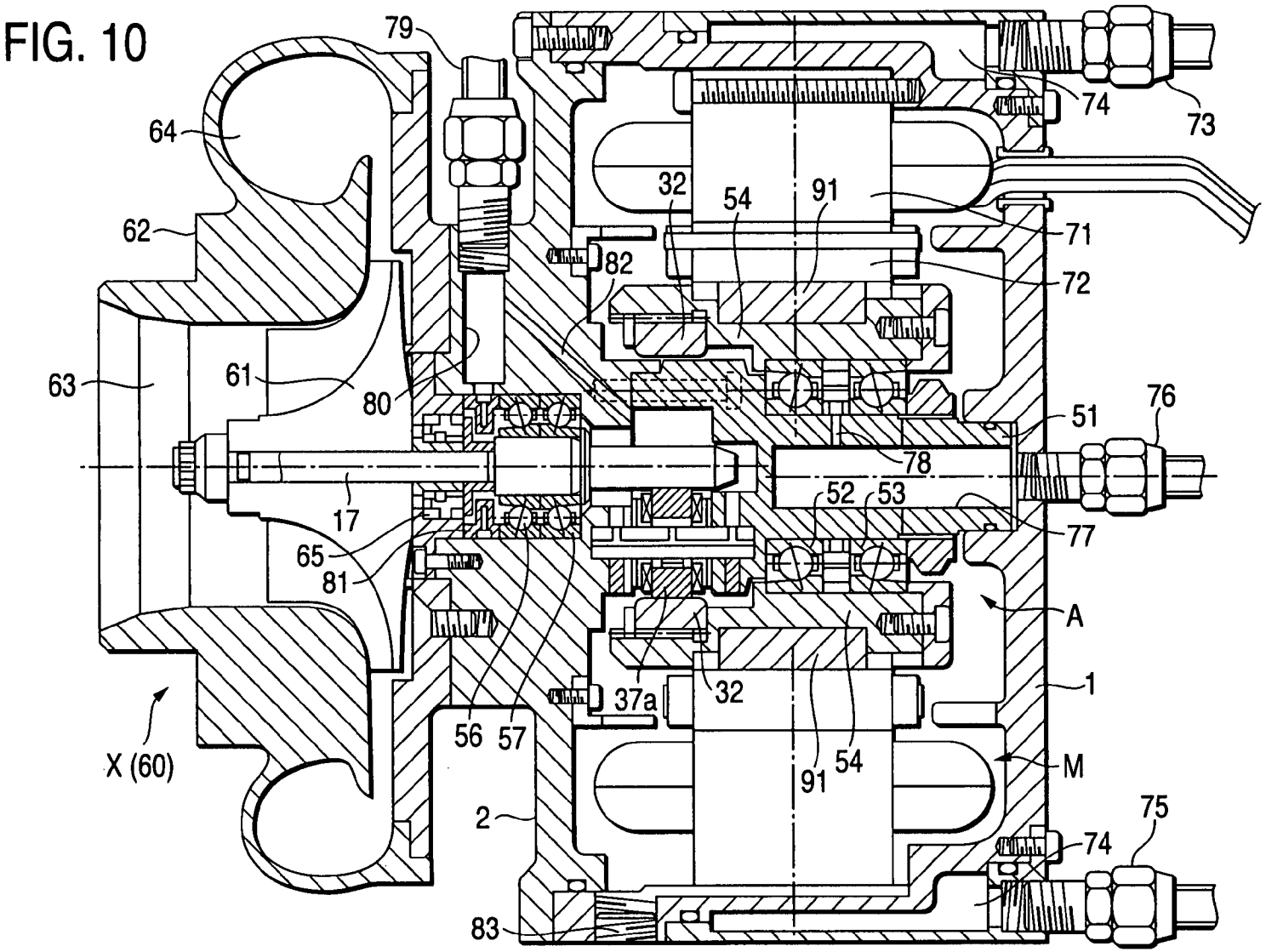
FIG. 10 is a vertical sectional view of the high-speed fluidic device according to a sixth embodiment of the invention.

FIG. 10 is a vertical sectional view of a high-speed fluidic device according to a sixth embodiment of the invention.

In this embodiment, as shown in FIG. 10, a supercharger 60 is used as the high-speed fluidic machine X. An impeller 61 of the supercharger 60 is mounted on an end portion of the high-speed side shaft 17. Incidentally, a housing 62 is formed around the impeller 61, an intake port 63 is provided in the axial outside of the impeller 61, and a scroll-shaped supercharging passage 64 is formed in the radial outside of the impeller 61.

The high-speed side shaft 17 is sealed with a mechanical seal 65 between the impeller 61 and the bearings 56 and 57.

An electric motor M as a drive source is shaped like a cylinder. The electric motor M includes a cylindrical stator 71 disposed in the housing 1, and a cylindrical rotor 72 rotated by the stator 71.

Incidentally, the housing 1 is formed so that a cooling water (oil) supply unit 73 can be connected to an upper portion of the housing 1. A cylindrical cooling water (oil) jacket 74 for circulating cooling water (oil) of the unit 73 is formed in the housing 1. The housing 1 is also formed so that a cooling water (oil) drainage unit 75 for draining cooling water (oil) from the cooling water (oil) jacket 74 can be connected to a lower portion of the housing 1.

The housing 1 is further formed so that a traction oil supply unit 76 can be connected to a center portion of the housing 1. Traction oil of the unit 76 can be supplied to the bearings 52 and 53 through a traction oil feed passage 77 and a radial passage 78 which are formed in the support shaft 51.

The housing 2, which is a partition plate, is formed so that a traction oil supply unit 79 can be connected to the housing 2. A traction oil feed passage 80 for leading traction oil into between the mechanical seal 65 and the bearings 56 and 57 is formed in the housing 2.

An annular guide member 81 is further provided between the mechanical seal 65 and the bearings 56 and 57 so that traction oil led from the traction oil feed passage 80 can be guided circumferentially by the guide member 81 to thereby be drained into the bearings 56 and 57 at a suitable place.

An oblique guide passage 82 for leading traction oil from the traction oil feed passage 80 to the respective rollers 37 and 38 is further provided in the housing 2.

A though-hole 83 is further formed in a lower portion of the housing 1 so that a traction oil drainage unit (not shown) can be connected to the through-hole 83.

In this embodiment, the cylindrical rotor 72 is fitted to an outer diameter side of the low-speed side ring 54 through a key 91. Accordingly, when the electric motor M drives the rotor 72, the low-speed side ring 54 and the outer ring 32 rotate together with the rotor 72. As a result, the high-speed side shaft 17 can be rotated at a highly increased speed by the function of the wedge roller type speed-increasing mechanism A to thereby drive the impeller 61 to rotate.

As described above, this embodiment is configured so that the impeller of the high-speed fluidic machine X can be driven by the wedge roller type speed-increasing mechanism A. Because the wedge roller type speed-increasing mechanism A is such a traction drive that quiet and smooth motive power transmission can be performed even at a high rotational speed, there is no problem in vibration and noise. Furthermore, because this is such a mechanism that pressing force required for the traction drive can be obtained by the wedging function, a proper pressing force proportional to transmission torque can be always obtained so that no slip occurs. At the same time, high efficiency can be obtained in a wide region of from a region of low rotational speed and low torque to a region of high rotational speed and high torque.

In addition, because the electric motor M is incorporated in the high-speed fluidic device, the position of installation in an engine room is not limited so that the electric motor M can be installed in an optimal position.

When, for example, the high-speed fluidic device according to this embodiment is used in an engine supercharger, the electric motor M can be controlled to obtain an optimal number of revolutions continuously. Accordingly, the quantity of supply air and boost pressure of the supercharger can be prevented from becoming excessive when the engine rotates at a high speed. Optimal supercharging can be always performed without provision of any other unit such as a continuously variable transmission.

Furthermore, according to this embodiment, because the electric motor M has a cylindrical rotor 72 fitted to the outer diameter side of the low-speed side ring 54 for driving the low-speed side ring 54 to rotate, the axial length can be reduced remarkably to attain reduction in size of the high-speed fluidic device.

In addition, when the centrifugal supercharger is used as the high-speed fluidic machine as described in this embodiment, there is a merit that excellent installability and reduction in electric power for driving the electric motor M can be obtained because the centrifugal supercharger per se is small in size as well as the size of the electric motor M can be reduced because of high efficiency.

Figure 11:
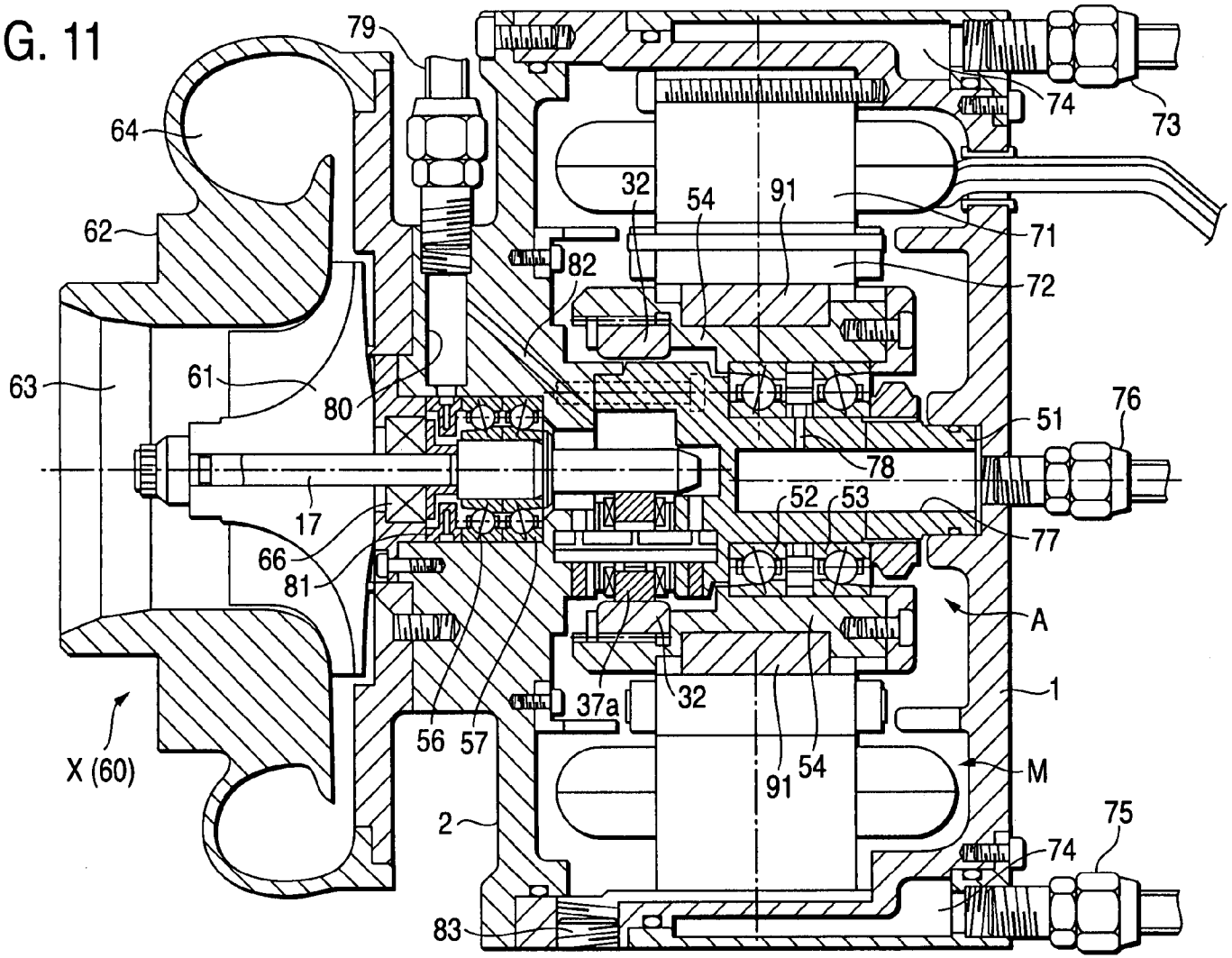
FIG. 11 is a vertical sectional view of the high-speed fluidic device according to a seventh embodiment of the invention.

FIG. 11 is a vertical sectional view of a high-speed fluidic device according to a seventh embodiment of the invention.

In this embodiment, as shown in FIG. 11, an oil seal 66 is used as a substitute for the mechanical seal 65.

That is, the high-speed side shaft 17 is sealed with the oil seal 66 between the impeller 61 and the bearings 56 and 57.

The other configuration, operation and effect of this embodiment are equivalent to those of the sixth embodiment.

Figure 12:
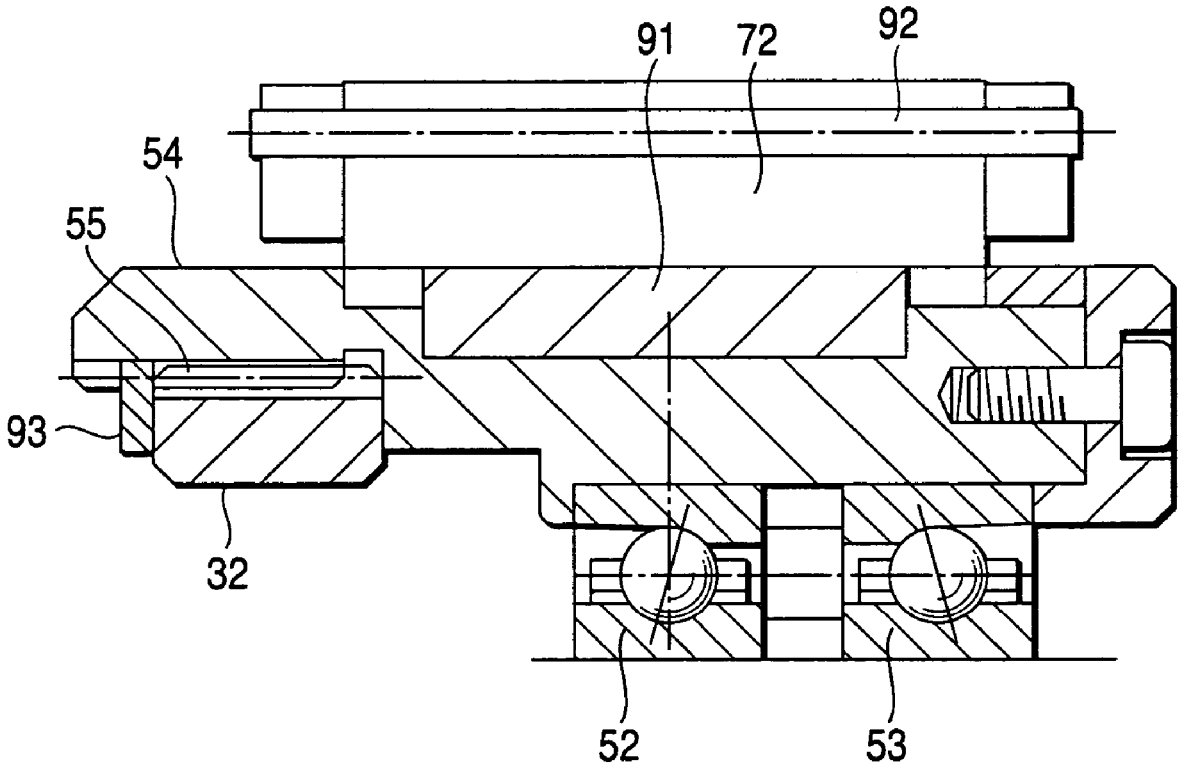
FIG. 12 is an enlarged sectional view showing main part of the high-speed fluidic device according to an eighth embodiment of the invention.

FIG. 12 is an enlarged sectional view of main part of the high-speed fluidic device depicted in FIG. 10 according to an eighth embodiment of the invention.

As shown in FIG. 12, the outer ring 32 is spline-fitted to an inner diameter side of a left end portion of the low-speed side ring 54 through a spline portion 55. Accordingly, the outer ring 32 has a degree of freedom in a radial direction, so that it is possible to absorb dimensional tolerance or displacement in mount position of the movable roller 38 (movable rollers 38*a* and 38*b*), the guide rollers 37*a* and 37*b* (guide roller 37), the support shafts 39*a* and 39*b*, the outer ring 32 and the high-speed side shaft 17. Accordingly, the contact surface pressures of the respective contact portions are optimized so that transmission efficiency can be kept high.

If the outer ring 32 and the low-speed side ring 54 are formed integrally with each other, it is impossible to absorb dimensional tolerance or displacement in mount position of the movable roller 38 (movable rollers 38*a* and 38*b*), the guide rollers 37*a* and 37*b* (guide roller 37), the support shafts 39*a* and 39*b*, the outer ring 32 and the high-speed side shaft 17. As a result, the contact surface pressures of the respective contact portions cannot be optimized, so that transmission efficiency is worsened. Furthermore, when one-sided bearing occurs, there is a possibility that failure such as premature friction may occur.

In this embodiment, the low-speed side ring 54 is formed integrally with the rotor 72. Accordingly, the mass of the low-speed side ring 54 including the rotor 72 is apt to be heavy compared with the conventional configuration (in which only the low-speed side ring 54 is a rotating body). When the rotor 72 and the low-speed side ring 54 rotate at a high speed, the influence of vibration caused by residual unbalance becomes large compared with the conventional configuration (in which only the low-speed side ring 54 is a rotating body). In this embodiment, it is however hard to transmit the vibration to the traction portion because spline fitting is used for connecting the outer ring 32 to the low-speed side ring 54. Accordingly, in this embodiment, transmission of motive power is very stable.

In this embodiment, the cylindrical rotor 72 is fitted to an outer diameter side of the low-speed side ring 54 through a key 91 as also shown in FIG. 12. Accordingly, when the electric motor M drives the rotor 72, the low-speed side ring 54 and the outer ring 32 rotate together with the rotor 72. As a result, the high-speed side shaft 17 can be rotated at a highly increased speed by the function of the wedge roller type speed-increasing mechanism A to thereby drive the impeller 61 to rotate.

Incidentally, the rotor 72 is made of a laminated steel plate. As shown in FIG. 12, shafts 92 are used for fixing the rotor 72. The shafts 92 are provided in a plurality of places on the circumference of a circle. In FIG. 12, the reference numeral 93 designates a C-snap ring.

As described above, this embodiment is configured so that the impeller of the high-speed fluidic machine X can be driven by the wedge roller type speed-increasing mechanism A. Because the wedge roller type speed-increasing mechanism A is such a traction drive that quiet and smooth motive power transmission can be performed even at a high rotational speed, there is no problem in vibration and noise. Furthermore, because this is such a mechanism that pressing force required for the traction drive can be obtained by the wedging function, a proper pressing force proportional to transmission torque can be always obtained so that no slip occurs. At the same time, high efficiency can be obtained in a wide region of from a region of low rotational speed and low torque to a region of high rotational speed and high torque.

In addition, because the electric motor M is incorporated in the high-speed fluidic device, the position of installation in an engine room is not limited so that the electric motor M can be installed in an optimal position.

When, for example, the high-speed fluidic device according to this embodiment is used in an engine supercharger, the electric motor M can be controlled to obtain an optimal number of revolutions continuously. Accordingly, the quantity of supply air and boost pressure of the supercharger can be prevented from becoming excessive when the engine rotates at a high speed. Optimal supercharging can be always performed without provision of any other unit such as a continuously variable transmission.

Furthermore, because the outer ring 32 is spline-fitted to the inner diameter side of the left end portion of the low-speed side ring 54 through the spline portion 55 as described above, the outer ring 32 has a degree of freedom in a radial direction, so that it is possible to absorb dimensional tolerance or displacement in mount position of the movable roller 38 (movable rollers 38*a* and 38*b*), the guide rollers 37*a* and 37*b* (guide roller 37), the support shafts 39*a* and 39*b*, the outer ring 32 and the high-speed side shaft 17. Accordingly, the contact surface pressures of the respective contact portions are optimized so that transmission efficiency can be kept high.

Figure 13:
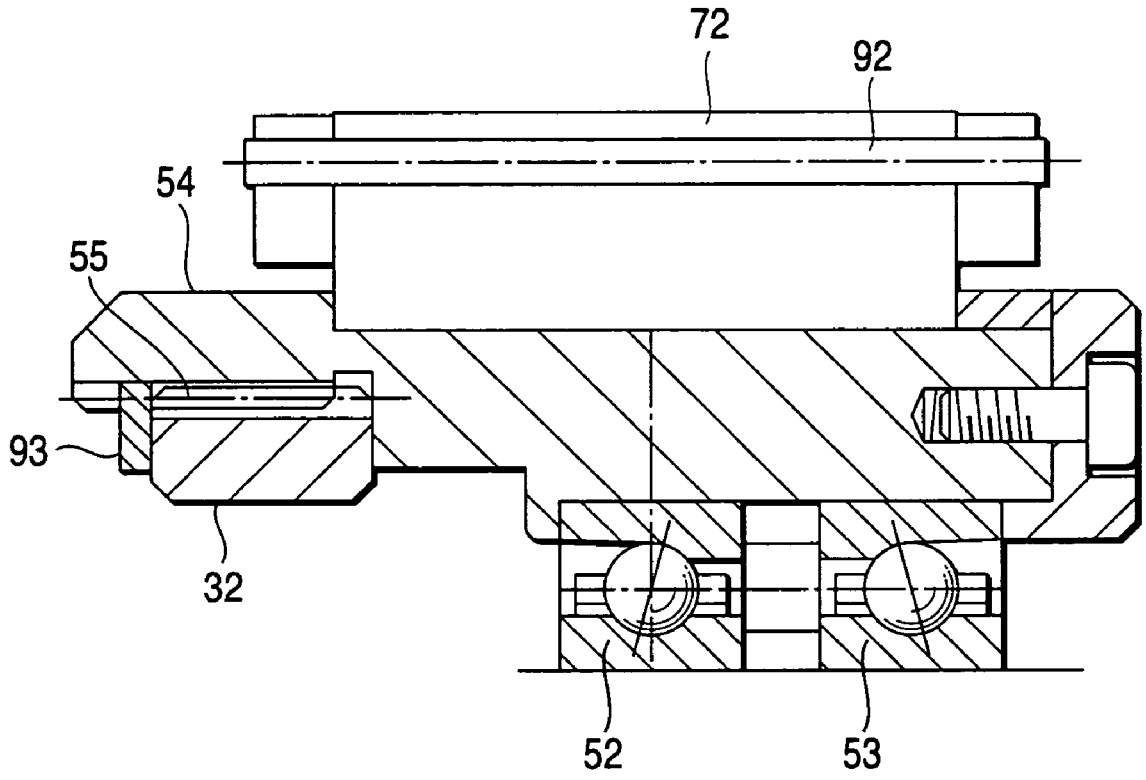
FIG. 13 is an enlarged sectional view showing main part of the high-speed fluidic device according to a ninth embodiment of the invention.

FIG. 13 is an enlarged sectional view of main part of the high-speed fluidic device according to a ninth embodiment of the invention.

In the ninth embodiment, the cylindrical rotor 72 is fitted to an outer diameter side of the low-speed side ring 54 by means of close fitting without use of the key 91. That is, close fitting is set so that a tightening margin (interference) is given to the fitting portion to make it impossible to form any gap in the fitting portion between the rotor 72 and the low-speed side ring 54 even in the case where the rotor 72 is rotating.

Accordingly, when the electric motor M drives the rotor 72, the low-speed side ring 54 and the outer ring 32 rotate together with the rotor 72. As a result, the high-speed side shaft 17 can be rotated at a highly increased speed by the function of the wedge roller type speed-increasing mechanism A to thereby drive the impeller 61 to rotate. The other configuration, operation, etc. of this embodiment are equivalent to those of the eighth embodiment.

Figure 14B:
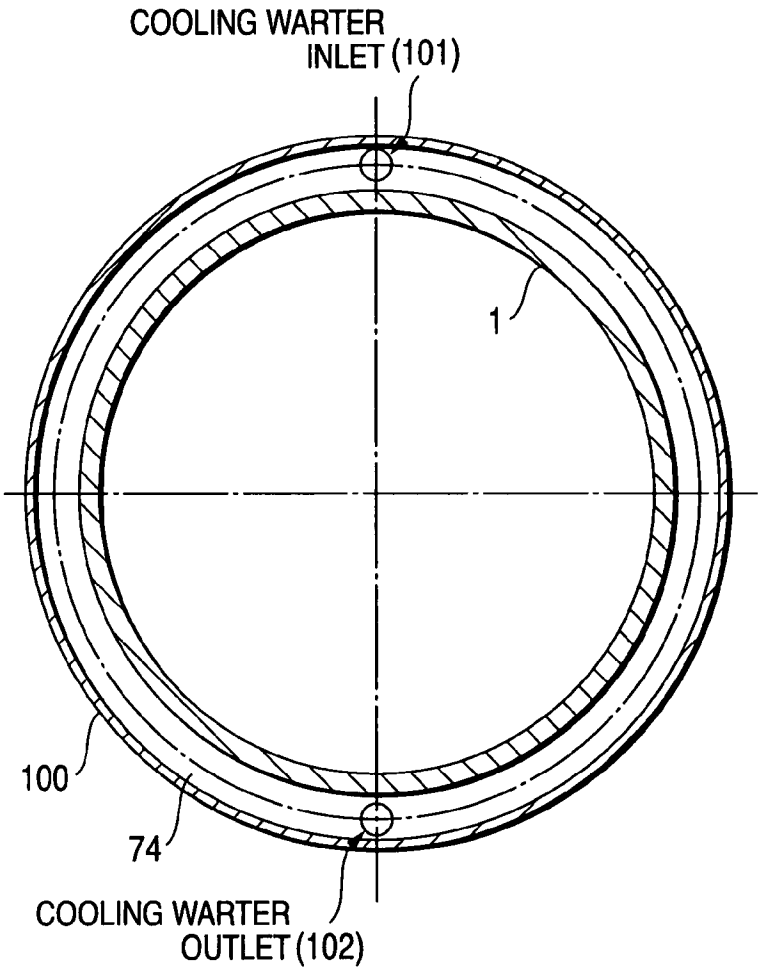
FIG. 14B is a cross sectional view of the housing of the high-speed fluidic device.
Figure 14A:
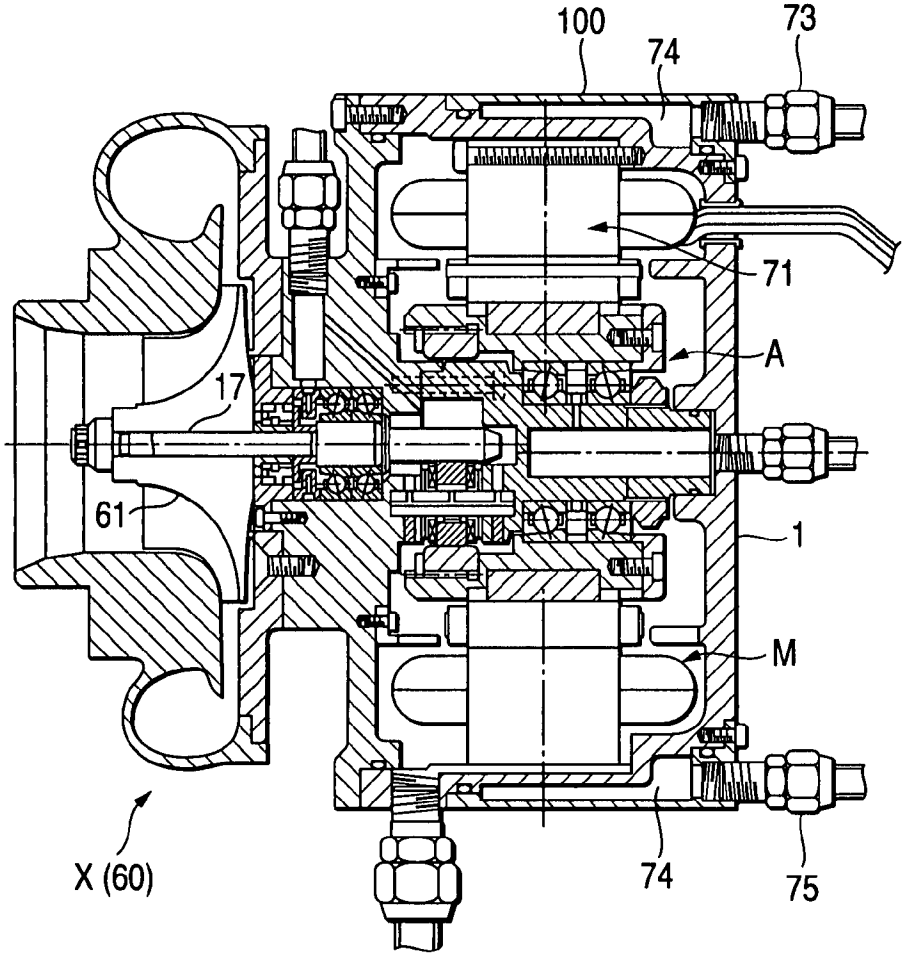
FIG. 14A is a vertical sectional view of the high-speed fluidic device according to a tenth embodiment of the invention.

FIG. 14A is a vertical sectional view of the high-speed fluidic device according to a tenth embodiment of the invention. FIG. 14B is a cross sectional view of the housing of the high-speed fluidic device.

This embodiment is configured so that a cooling water (medium) supply unit 73 for supplying cooling water (medium) can be connected to an upper portion of the housing 1. The cooling water is preferably engine cooling water but may be another cooling medium.

A cylindrical cooling jacket 100 for circulating the cooling water (medium) is provided in the outer circumferential portion of the housing 1 and in the radial outside of the stator 71. As shown in FIG. 14B, an annular cooling water (medium) passage 74 for circulating the cooling water (medium) is formed in the cooling jacket 100 and throughout the whole circumference of the outer circumferential portion of the housing 1.

Further, a cooling water (medium) drainage unit 75 for draining the cooling water (medium) from the cooling water passage 74 of the cooling jacket 100 can be connected to a lower portion of the housing 1.

Accordingly, cooling water fed from the cooling water supply unit 73 circulates in the annular cooling water passage 74 through a cooling water inlet 101 and then is drained from the cooling water drainage unit 75 through a cooling water outlet 102.

Although there is shown the case where the cooling water supply unit 73 and the cooling water drainage unit 75 are axially connected to the housing 1, the invention is not limited thereto. For example, they may be radially connected to the housing 1.

As described above, in accordance with this embodiment, because the cooling jacket 100 for circulating cooling water (medium) is provided in the housing 1, the wedge roller type transmission A can be cooled efficiently to prevent the temperature of the wedge roller type transmission A from increasing excessively.

Accordingly, increase in cost caused the provision of a new exclusive cooling unit (such as a cooler, a pump, a temperature sensor, an ON/OFF switch, etc.) can be avoided. The performance and durability of the wedge roller type transmission A can be kept stable at low cost as well as the wedge roller type transmission A can be cooled efficiently.

In addition, this embodiment is configured so that the impeller of the high-speed fluidic machine X can be driven by the wedge roller type speed-increasing mechanism A. Because the wedge roller type speed-increasing mechanism A is such a traction drive that quiet and smooth motive power transmission can be performed even at a high rotational speed, there is no problem in vibration and noise. Furthermore, because this is such a mechanism that pressing force required for the traction drive can be obtained by the wedging function, a proper pressing force proportional to transmission torque can be always obtained so that no slip occurs. At the same time, high efficiency can be obtained in a wide region of from a region of low rotational speed and low torque to a region of high rotational speed and high torque.

Figure 15B:
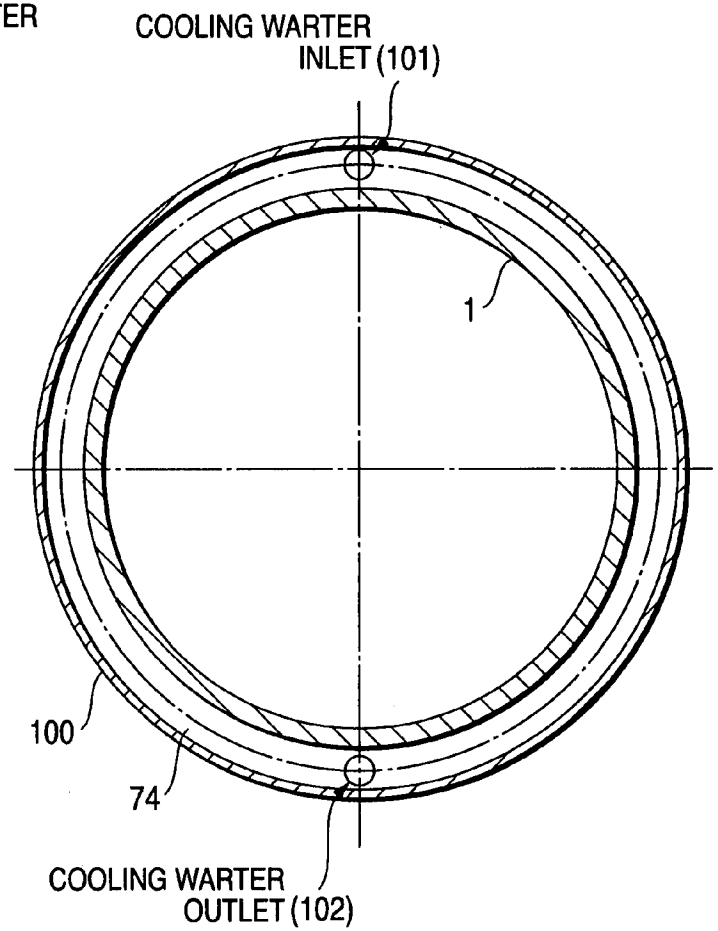
FIG. 15B is a cross sectional view of the housing of the high-speed fluidic device.
Figure 15A:
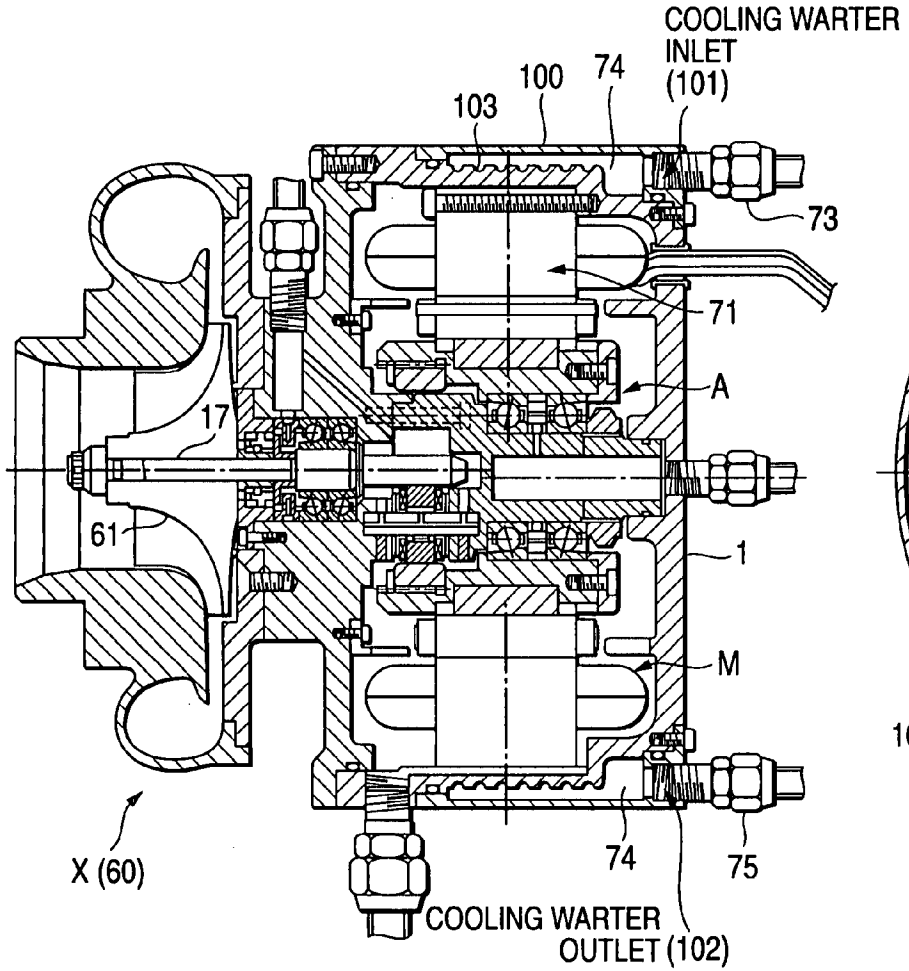
FIG. 15A is a vertical sectional view of the high-speed fluidic device according to an eleventh embodiment of the invention.

FIG. 15A is a vertical sectional view of the high-speed fluidic device according to an eleventh embodiment of the invention. FIG. 15B is a cross sectional view of the housing of the high-speed fluidic device.

This embodiment is configured so that a large number of circumferential concave grooves 103 for enlarging the heat-radiating area are formed in the cooling water passage 74. Accordingly, the wedge roller type transmission A can be cooled more efficiently. The other configuration, operation, etc. of this embodiment are equivalent to those of the tenth embodiment.

Incidentally, the shape of each of the circumferential concave grooves 103 is not limited to the shape shown in FIG. 15A. Any shape such as a semicircular shape, a concavo-convex shape or a helical shape may be used if the heat-radiating area can be enlarged.

Figure 16B:
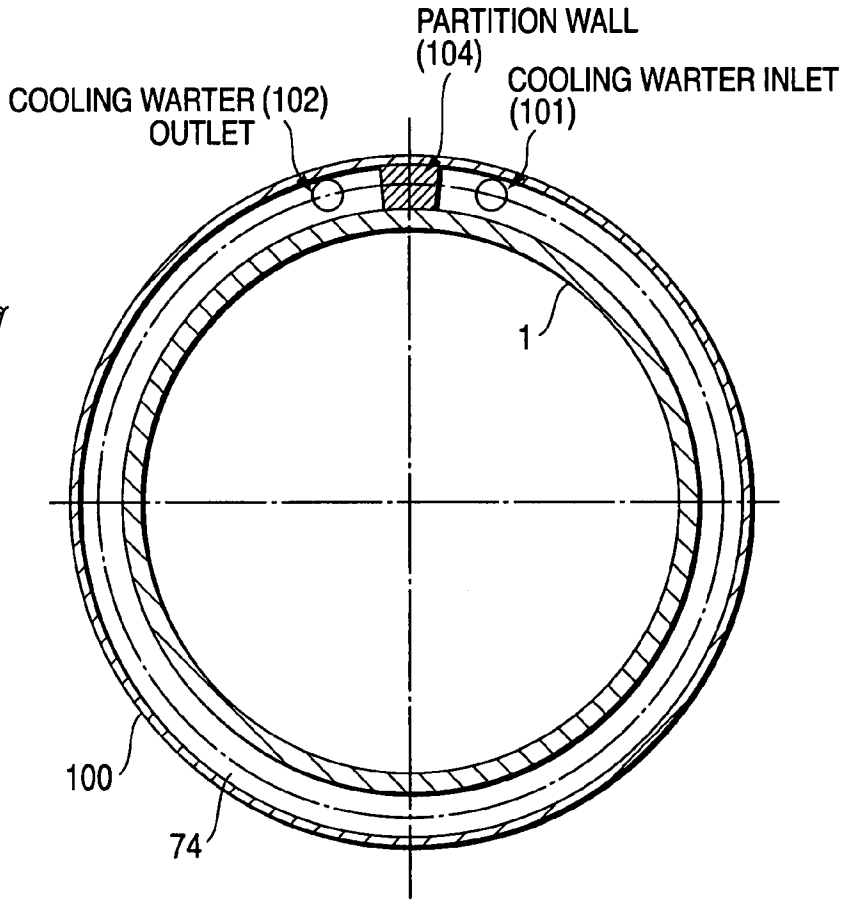
FIG. 16B is a cross sectional view of the housing of the high-speed fluidic device; and, FIG. 17A is a vertical sectional view of the high-speed fluidic device according to a thirteenth embodiment of the invention.
Figure 16A:
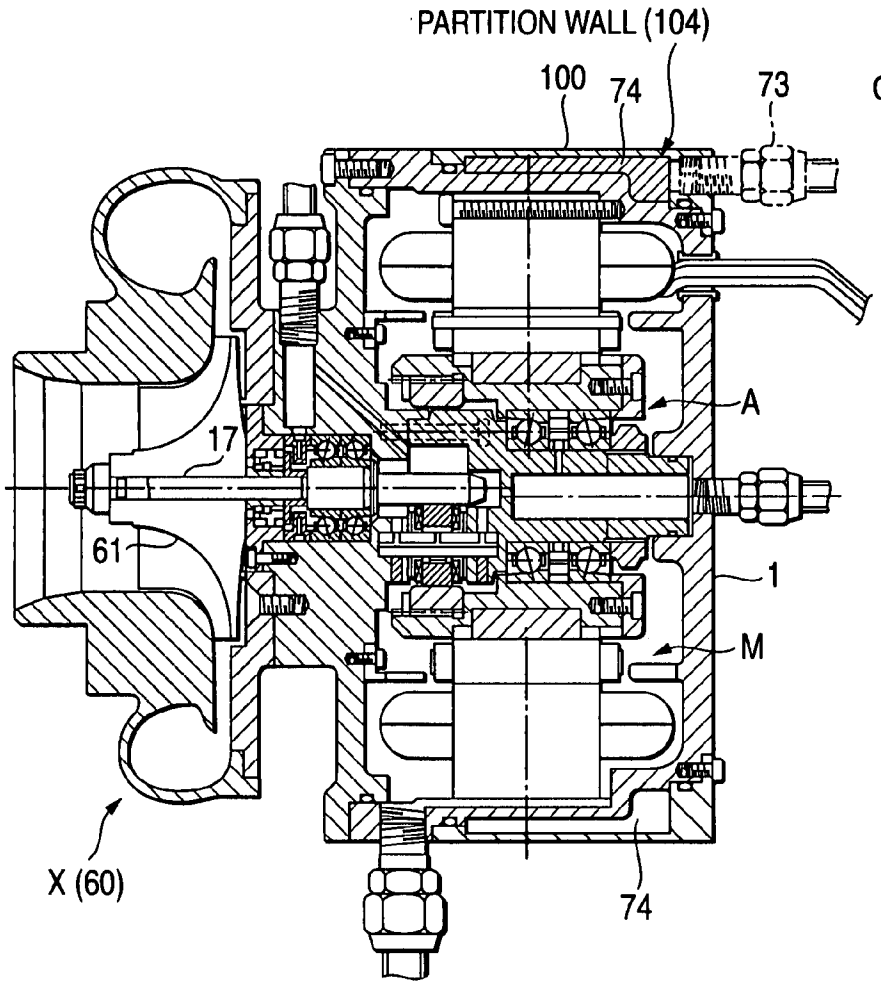
FIG. 16A is a vertical sectional view of the high-speed fluidic device according to a twelfth embodiment of the invention.

FIG. 16A is a vertical sectional view of the high-speed fluidic device according to a twelfth embodiment of the invention. FIG. 16B is a cross-sectional view of the housing of the high-speed fluidic device.

This embodiment is configured so that a cooling water inlet 101 and a cooling water outlet 102 are disposed on both sides of a partition wall 104 which is provided in the cooling water passage 74. Accordingly, cooling water circulates in the cooling water passage 74 on its whole circumference through the cooling water inlet 101 and then is drained through the cooling water outlet 102. Accordingly, the cooling water can flow in one direction. The other configuration, operation, etc. of this embodiment are equivalent to those of the eleventh embodiment.

Figure 17B:
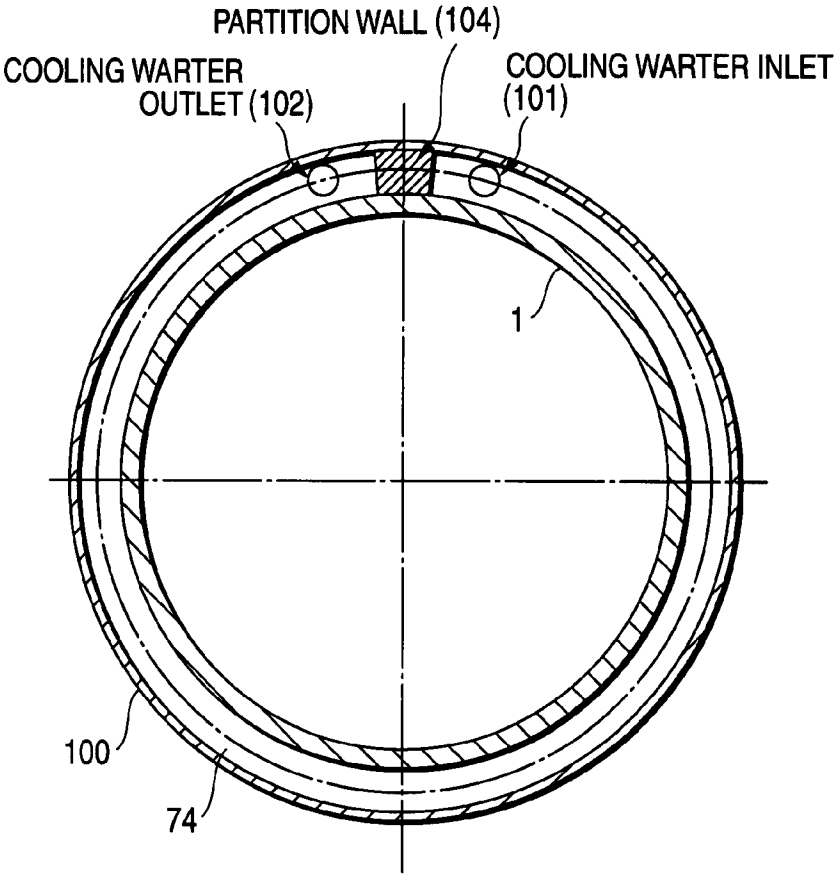
FIG. 17B is a cross sectional view of the housing of the high-speed fluidic device.
Figure 17A:
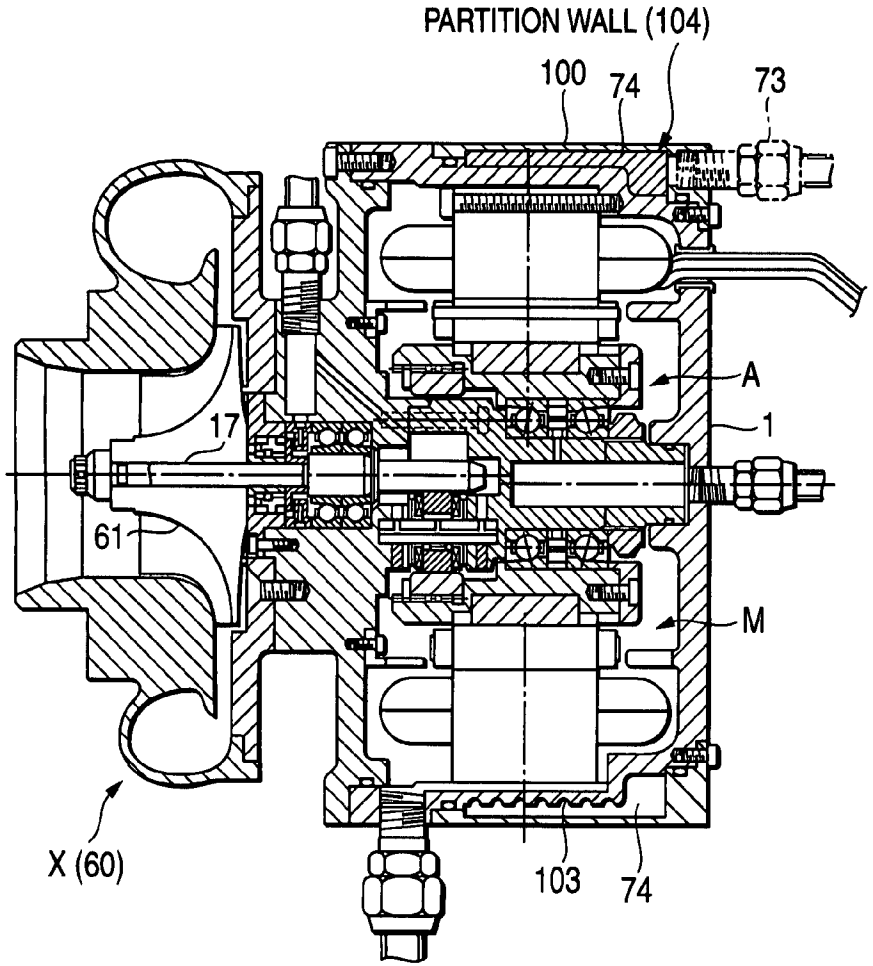

FIG. 17A is a vertical sectional view of the high-speed fluidic device according to a thirteenth embodiment of the invention. FIG. 17B is a cross sectional view of the housing of the high-speed fluidic device.

This embodiment is configured so that a large number of circumferential concave grooves 103 for enlarging the heat-radiating area are formed in the cooling water passage 74. Accordingly, the wedge roller type transmission A can be cooled more efficiently. Incidentally, the shape of each of the circumferential concave grooves 103 is not limited to the shape shown in FIG. 17A. Any shape such as a semicircular shape, a concavo-convex shape or a helical shape may be used if the heat-radiating area can be enlarged.

This embodiment is further configured so that a cooling water inlet 101 and a cooling water outlet 102 are disposed on both sides of a partition wall 104 which is provided in the cooling water passage 74. Accordingly, cooling water circulates in the cooling water passage 74 on its whole circumference through the cooling water inlet 101 and then is drained through the cooling water outlet 102. Accordingly, the cooling water can flow in one direction. The other configuration, operation, etc. of this embodiment are equivalent to those of the twelfth embodiment.

Incidentally, the invention is not limited to the embodiments and various changes may be made. For example, in the high-speed fluidic device according to the invention, the high-speed fluidic machine may be a ventilator. In the high-speed fluidic device according to the invention, the ventilator as the high-speed fluidic machine may be a centrifugal high-speed fluidic machine, a positive-displacement fluidic machine or an axial-flow fluidic machine. In the high-speed fluidic device according to the invention, the centrifugal fluidic machine may preferably include an impeller. In the high-speed fluidic device according to the invention, the positive-displacement fluidic machine may be a Roots positive-displacement fluidic machine. In the high-speed fluidic device according to the invention, the axial-flow fluidic machine may be a Lysholm axial-flow fluidic machine.

As described above, the invention is configured so that a high-speed fluidic machine is driven by a friction roller type speed-increasing mechanism using a wedging function. Because the wedge roller type speed-increasing mechanism is such a traction drive that quiet and smooth motive power transmission can be performed even at a high rotational speed, there is no problem in vibration and noise. Furthermore, because this is such a mechanism that pressing force required for the traction drive can be obtained by the wedging function, a proper pressing force proportional to transmission torque can be always obtained so that no slip occurs. At the same time, high efficiency can be obtained in a wide region of from a region of low rotational speed and low torque to a region of high rotational speed and high torque.

In addition, an electric motor is used as a source for driving the wedge roller type speed-increasing mechanism. For example, in the case of use in an engine room or the like, the position of installation in the engine room is not limited so that the electric motor can be installed in an optimal position.

Furthermore, in accordance with the invention, there is no problem in vibration and noise because quiet and smooth motive power transmission can be performed even at a high rotational speed. Furthermore, because this is such a mechanism that pressing force required for the traction drive can be obtained by the wedging function, a proper pressing force proportional to transmission torque can be always obtained so that no slip occurs. At the same time, high efficiency can be obtained in a wide region of from a region of low rotational speed and low torque to a region of high rotational speed and high torque.

Furthermore, in accordance with the invention, because the electric motor is used as a drive source, the position of installation is not limited, for example, in the case of use in an engine room or the like so that the electric motor can be installed in an optimal position.

Furthermore, the motor can be controlled to obtain an optimal number of revolutions continuously. Accordingly, the quantity of supply air and boost pressure of the supercharger can be prevented from becoming excessive when the engine rotates at a high-speed. Optimal supercharging can be always performed without provision of any other unit such as a continuously variable transmission.

Incidentally, there has been heretofore no speed-increasing mechanism capable of increasing the number of revolutions to be larger than a value in a range of from the order of tens of thousands of rpm to the order of a hundred thousand of rpm. Such a system driven by an electric motor has been never obtained.

Furthermore, in accordance with the invention, the electric motor has a cylindrical rotor which is fitted to an outer diameter side of the low-speed side ring to thereby drive the low-speed side ring to rotate. Accordingly, the axial length can be reduced remarkably, so that reduction in size of the high-speed fluidic device can be attained.

Furthermore, when the high-speed fluidic machine is applied to a centrifugal supercharger as described in the invention, the centrifugal supercharger per se is small-sized as well as the electric motor can be small-sized because of high efficiency. Accordingly, there is a merit that electric power for driving the motor can be reduced as well as good installability can be obtained.

Furthermore, the high-speed fluidic device according to the invention can be applied not only to the engine supercharger but also to a ventilator for feeding hydrogen as fuel, a blower for blowing out water and water vapor produced by a reaction of hydrogen and oxygen, and so on, for example, in a vehicle powered by fuel battery.

Furthermore, because the outer ring is spline-fitted to the inner diameter side of the low-speed side ring, the outer ring has a degree of freedom in a radial direction. Dimensional tolerance or displacement in mount position of the movable roller, the guide roller, the support shafts of the rollers, the outer ring and the high-speed side shaft can be absorbed so that the contact surface pressure of each contact portion can be set to be an optimal value. Accordingly, high transmission efficiency can be kept.

Furthermore, because the cooling jacket for circulating a cooling medium is provided in the housing, the friction roller type transmission can be cooled so efficiently that the temperature of the friction roller type transmission can be prevented from increasing excessively. Accordingly, increase in cost caused by the provision of a new exclusive cooling unit (a cooler, a pump, a temperature sensor, an ON/OFF switch, etc.) can be avoided. The wedge roller type transmission can be cooled efficiently, so that performance and durability can be kept stable at low cost.

What is claimed is:

1. A high-speed fluidic device comprising a friction roller type speed-increasing mechanism, an electric motor, and a high-speed fluidic machine, wherein:

the friction roller type speed-increasing mechanism includes a housing, a low-speed side member having an outer ring provided at one end portion thereof, a high-speed side shaft rotatably supported by the housing so as to be eccentric to the low-speed side member and the outer ring, at least one guide roller rotatably supported between the outer ring and the high-speed side shaft, and at least one movable roller rotatably supported between the outer ring and the high-speed side shaft;

the electric motor drives the friction roller type speed-increasing mechanism; and the high-speed fluidic machine is connected to the high-speed side shaft so as to be driven by the high-speed side shaft, and further comprising a continuously stationary member fixed to the housing, wherein the low-speed side member is a low-speed side ring rotatably supported by the continuously stationary member.

2. A high-speed fluidic device comprising a friction roller type speed-increasing mechanism, an electric motor, and a high-speed fluidic machine, wherein:

the friction roller type speed-increasing mechanism includes a housing, a continuously stationary member fixed to the housing, a low-speed side ring rotatably supported by the continuously stationary member, an outer ring fitted to an inner diameter side of the low-speed side ring so as to rotate together with the low-speed side ring, a high-speed side shaft eccentric to the low-speed side ring and the outer ring, at least one guide roller rotatably supported between the outer ring and the high-speed side shaft, and at least one movable roller rotatably supported between the outer ring and the high-speed side shaft;

the electric motor drives the friction roller type speed-increasing mechanism and includes a cylindrical rotor fitted to an outer diameter side of the low-speed side ring for driving the low-speed side ring to rotate; and the high-speed fluidic machine is connected to the high-speed side shaft so as to be driven by the high-speed side shaft.

3. The high-speed fluidic device according to claim 2, wherein the outer ring is further spline-fitted to an inner diameter side of the low-speed side ring.

4. The high-speed fluidic device according to claim 2, wherein a cooling jacket for circulating a cooling medium is provided in the housing.

* * * * *